US007820902B2

(12) United States Patent
Furukawa et al.

(10) Patent No.: US 7,820,902 B2
(45) Date of Patent: Oct. 26, 2010

(54) MUSIC PERFORMANCE SYSTEM FOR MUSIC SESSION AND COMPONENT MUSICAL INSTRUMENTS

(75) Inventors: Rei Furukawa, Hamamatsu (JP); Yuji Fujiwara, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 176 days.

(21) Appl. No.: 12/203,191

(22) Filed: Sep. 3, 2008

(65) Prior Publication Data

US 2009/0084248 A1 Apr. 2, 2009

(30) Foreign Application Priority Data

Sep. 28, 2007 (JP) ..... 2007-255143

(51) Int. Cl.
*G10H 7/00* (2006.01)

(52) U.S. Cl. ..... 84/609; 84/615; 84/621; 84/649

(58) Field of Classification Search ..... 84/600–602, 84/645, 609, 615, 649, 653, 621
See application file for complete search history.

(56) References Cited

U.S. PATENT DOCUMENTS 4,357,853 A * 11/1982 Rosler et al. ..... 84/653
4,412,470 A * 11/1983 Jones ..... 84/645
5,254,804 A 10/1993 Tamaki et al.
5,376,750 A * 12/1994 Takeda et al. ..... 84/602
5,739,450 A * 4/1998 Fujiwara et al. ..... 84/462
5,880,386 A * 3/1999 Wachi et al. ..... 84/601
6,067,566 A * 5/2000 Moline ..... 709/219
6,069,310 A * 5/2000 James ..... 84/645
6,143,973 A * 11/2000 Kikuchi ..... 84/645
6,653,545 B2 * 11/2003 Redmann et al. ..... 84/615
6,700,050 B2 * 3/2004 Sakurada et al. ..... 84/615
7,002,068 B2 * 2/2006 Koseki et al. ..... 84/604
7,050,462 B2 * 5/2006 Tsunoda et al. ..... 370/474
7,129,408 B2 * 10/2006 Uehara ..... 84/645
7,189,911 B2 * 3/2007 Isozaki ..... 84/609
7,288,712 B2 * 10/2007 Uehara ..... 84/645
7,297,858 B2 * 11/2007 Paepcke ..... 84/609
7,339,105 B2 * 3/2008 Eitaki ..... 84/615
7,381,882 B2 * 6/2008 Usa ..... 84/626
7,405,355 B2 * 7/2008 Both et al. ..... 84/645
7,633,003 B2 * 12/2009 Usa et al. ..... 84/609
2001/0054346 A1 12/2001 Uehara
2003/0000368 A1 * 1/2003 Isozaki ..... 84/609

(Continued)

FOREIGN PATENT DOCUMENTS

EP 0239917 10/1987

(Continued)

*Primary Examiner*—David S. Warren
(74) *Attorney, Agent, or Firm*—Harness, Dickey & Pierce, PLC

(57) ABSTRACT

Automatic player pianos and internet form a music performance system for a music session on the automatic player pianos through data communication between the automatic player pianos, and a communication time lag and mechanical time lag are unavoidably introduced between the data transmission and the data reception and between the data reception and tone generation; one of or both of the time lags are compensated by employment of an electronic tone generation, presumption of key positions or presumption of key event so that the slave automatic player piano generates the tones almost concurrently with the tones generated through the master automatic player piano.

17 Claims, 21 Drawing Sheets

U.S. PATENT DOCUMENTS

| | | | | |
|---|---|---|---|---|
| 2003/0121401 | A1* | 7/2003 | Ito | 84/625 |
| 2003/0164084 | A1* | 9/2003 | Redmann et al. | 84/615 |
| 2003/0172797 | A1* | 9/2003 | Juszkiewicz et al. | 84/601 |
| 2005/0056141 | A1* | 3/2005 | Uehara | 84/645 |
| 2005/0150362 | A1* | 7/2005 | Uehara | 84/645 |
| 2006/0054004 | A1* | 3/2006 | Funaki | 84/600 |
| 2006/0130640 | A1* | 6/2006 | Fujiwara | 84/626 |
| 2007/0028750 | A1* | 2/2007 | Darcie et al. | 84/625 |
| 2007/0163426 | A1* | 7/2007 | Eitaki | 84/609 |
| 2008/0134865 | A1* | 6/2008 | Puryear | 84/645 |

FOREIGN PATENT DOCUMENTS

| | | |
|---|---|---|
| EP | 0326969 | 8/1989 |
| EP | 1014327 | 6/2000 |
| EP | 1555650 | 7/2005 |
| JP | 09062255 | 3/1997 |
| JP | 2005141246 | 6/2005 |
| JP | 2006-178197 A | 7/2006 |

* cited by examiner

MUSIC PERFORMANCE SYSTEM FOR MUSIC SESSION AND COMPONENT MUSICAL INSTRUMENTS

FIELD OF THE INVENTION

This invention relates to a music performance system for players remote from one another and, more particularly, to a music performance system with plural musical instruments communicable with one another through a communication network.

DESCRIPTION OF THE RELATED ART

An automatic player piano is a combination between an acoustic piano and an automatic playing system, and a human player or an automatic player, which is implemented by a computerized key driving system, performs music tunes on the acoustic piano. The automatic player has solenoid-operated key actuators, which are installed under the keyboard, and are selectively energized under the control of a computer system on the basis of pieces of music data.

The automatic player piano is available for a music performance system. An example of the music performance system is disclosed in Japan Patent Application laid-open No. 2006-178197. Two automatic player pianos are incorporated in the prior art music performance system. One of the automatic player pianos serves as a master musical instrument, and the other serves as a slave musical instrument. While a human player is fingering a music tune on the master musical instrument, music data codes, which express the performance on the master musical instrument, are produced in the computer system of master musical instrument, and are transferred to the computer system of the slave musical instrument. The pieces of music data, which are held in the music data codes, are analyzed in the computer system of slave musical instrument, and the keys to be moved and target trajectories for the keys are determined through the analysis. The solenoid-operated key actuators for the keys to be moved are energized in such a manner that the plungers of solenoid-operated key actuators force the keys to travel on the target trajectories. As a result, the hammers of slave musical instrument are driven for rotation, and are brought into collision with the strings so as to produce the piano tones without fingering on the slave musical instrument. Thus, the human player performs the music tune through both of the master musical instrument and slave musical instrument on the basis of the fingering on the keyboard of master musical instrument.

In the following description, term "music session" means a real-time performance in which the music data expressing fingering on a component musical instrument is transferred through a communication network to another component musical instrument for the automatic playing and/or vice versa.

Although the prior art music performance system permits a human player to drive the keys of slave musical instrument through the fingering on the keyboard of master musical instrument, the inventor of prior art music performance system does not aim at the music session. The pieces of music data unidirectionally flow from the master musical instrument to the slave musical instrument.

Even if the roll of master musical instrument and the roll of slave musical instrument are dynamically changed between the two automatic player pianos, the music session does not smoothly proceed. Time lag takes place between the fingering on the master musical instrument and the tones produced through the slave musical instrument. The time lag is partially due to the data transfer from the master musical instrument to the slave musical instrument, and the solenoid-operated key actuators consume the time period of the order of hundreds milliseconds. However, any countermeasure against the time lag is not incorporated in the prior art music performance system. In case where the automatic player pianos are connected to one another through a data communication network such as the internet, the above-described problems become serious.

SUMMARY OF THE INVENTION

It is therefore an important object of the present invention to provide a music performance system, which makes it possible to reduce the time lag between fingering on a component musical instrument and tones produced through another component musical instrument.

It is also an important object of the present invention to provide a musical instrument, which forms a part of the music performance system.

In accordance with one aspect of the present invention, there is provided a music performance system for a music performance on plural musical instruments comprising a master musical instrument including plural manipulators selectively moved for specifying tones to be produced, a converter monitoring the plural manipulators and producing detecting signals representative of physical quantity expressing movements of the plural manipulators, an information processing system connected to the converter and producing pieces of performance data expressing a performance on the plural manipulators on the basis of the physical quantity and a communication system connected between the information processing system and a communication channel for transmitting the pieces of performance data through the communication channel, a slave musical instrument including another communication system connected to the communication channel and receiving the pieces of performance data from the communication system, other manipulators for specifying tones to be produced, plural actuators provided for the other manipulators and selectively energized with driving signals so as to give rise to movements of the other manipulators on trajectories, a mechanical tone generating system connected to the other manipulators and producing acoustic tones when the other manipulators strongly actuate it, an electronic tone generating system for producing electric tones on the basis of the pieces of performance data and a controlling system connected to the aforesaid another communication system, the plural actuators and the electronic tone generating system and selectively supplying the driving signals produced on the basis of the pieces of performance data to the plural actuators so as selectively to move the other manipulators on the trajectories and the pieces of performance data to the electronic tone generating system so as to produce the electric tones, and a delay canceller provided in association with at least one of the information processing system, electronic tone generating system and controlling system so as to reduce a time lag between the transmission of the pieces of performance data and the generation of the electric tones or the acoustic tones.

In accordance with another aspect of the present invention, there is provided a musical instrument forming a part of a music performance system comprising plural manipulators selectively moved for specifying tones to be produced, a converter monitoring the plural manipulators and producing detecting signals representative of physical quantity expressing movements of the plural manipulators, an information processing system connected to the converter and producing pieces of performance data expressing a performance on the plural manipulators on the basis of the physical quantity, a communication system connected between the information processing system and a communication channel for transmitting the pieces of performance data to another musical instrument through the communication channel, and a delay canceller provided in association with the information processing system so as to reduce a time lag between the transmission of the pieces of performance data and the generation of electric tones or acoustic tones produced through the aforesaid another musical instrument.

In accordance with yet another aspect of the present invention, there is provided a musical instrument forming a part of a music performance system comprising a communication system connected to a communication channel and receiving pieces of performance data expressing movements of manipulators of another musical instrument through the communication channel, plural manipulators for specifying tones to be produced, plural actuators provided for the plural manipulators and selectively energized with driving signals so as to give rise to movements of the plural manipulators on trajectories, a mechanical tone generating system connected to the plural manipulators and producing acoustic tones when the plural manipulators strongly actuate it, an electronic tone generating system for producing electric tones on the basis of the pieces of performance data, a controlling system connected to the communication system, the plural actuators and the electronic tone generating system and selectively supplying the driving signals produced on the basis of the pieces of performance data to the plural actuators so as selectively to move the plural manipulators on the trajectories and the pieces of performance data to the electronic tone generating system so as to produce the electric tones, and a delay canceller provided in association with at least one of the electronic tone generating system and controlling system so as to reduce a time lag between transmission of the pieces of performance data and the generation of the electric tones or the acoustic tones.

BRIEF DESCRIPTION OF THE DRAWINGS

The features and advantages of the music performance system will be more clearly understood from the following description taken in conjunction with the accompanying drawings, in which.

DESCRIPTION OF THE PREFERRED EMBODIMENTS

Figure 1:
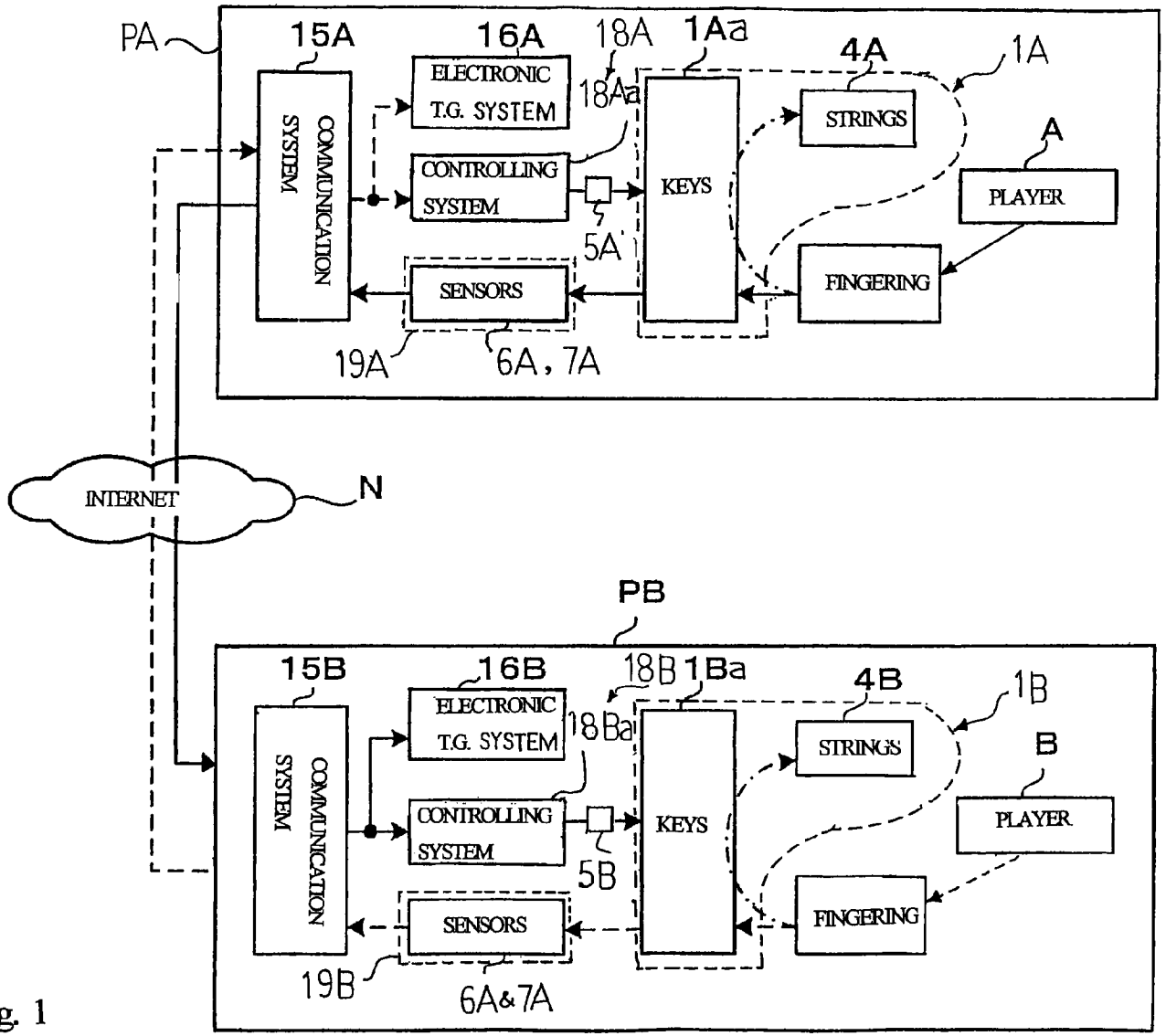
FIG. 1 is a block diagram showing the system configuration of a music performance system of the present invention.

A music performance system embodying the present invention is available for a music performance on plural musical instruments, and largely comprises a master musical instrument, a slave musical instrument and a delay canceller. Pieces of performance data are produced in the master musical instrument, and are supplied from the master musical instrument to the slave musical instrument through a communication channel. Acoustic tones or electric tones are produced in the slave musical instrument on the basis of the pieces of performance data, and manipulators of slave musical instrument are moved without any fingering of a human player. Although a time lag is introduced from the transmission of performance data to the generation of tones in the slave musical instrument, at least a part of the time lag is cancelled by virtue of the delay canceller. Thus, a music session is realized on the master musical instrument and slave musical instrument.

The master musical instrument includes plural manipulators, a converter, an information processing system and a communication system. The plural manipulators are used for specifying tones to be produced. While a human player is fingering a music tune on the plural manipulators, by way of example, the tones on a music score is sequentially specified through the plural manipulators.

The converter monitors the plural manipulators, and produces detecting signals representative of physical quantity of the plural manipulators. The physical quantity expresses movements of the plural manipulators so that the detecting signals are available for reproduction of key movements. The information processing system is connected to the converter, and producing pieces of performance data expressing a performance on the plural manipulators on the basis of the physical quantity. The communication system is connected between the information processing system and the communication channel for transmitting the pieces of performance data through the communication channel to the slave musical instrument.

The slave musical instrument includes another communication system, the other manipulators, plural actuators, a mechanical tone generating system, an electronic tone generating system and a controlling system. Acoustic tones are produced through the mechanical tone generating system, and electric tones are produced through the electronic tone generating system. Thus, the slave musical instrument is capable of producing the acoustic tones and electric tones.

The other manipulators are used for specifying tones to be produced so that human beings recognize the movements of other manipulator as a performance on the slave musical instrument. The plural actuators are provided for the other manipulators. The plural actuators are selectively energized with driving signals so as to give rise to the movements of other manipulators on trajectories without any fingering of a human player. Since the mechanical tone generating system connected to the other manipulators, the plural actuators can produce the acoustic tones through the mechanical tone generating system. When the other manipulators strongly actuate the mechanical tone generating system, the mechanical tone generating system starts to produce the acoustic tones. On the other hand, if the actuators weakly actuate the mechanical tone generating system, any acoustic tone is not produced through the mechanical tone generating system. If the actuators strongly actuate the other manipulators, the other manipulators also strongly actuate the mechanical tone generating system, and the mechanical tone generating system responds to the movements of other manipulators so as to produce the acoustic tones. Thus, the actuators make it possible selectively to produce the movements of other manipulators and both of the movements and acoustic tones.

The communication system of slave musical instrument is connected to the communication channel so that the pieces of performance data arrive thereat. The controlling system is connected to the aforesaid another communication system, the plural actuators and the electronic tone generating system. When the pieces of performance data arrive at the communication system, the pieces of performance data are transferred from the communication system to the controlling system. The controlling system analyzes the pieces of performance data for determining the tones to be produced, and selectively supplies the driving signals, which are produced on the basis of the pieces of performance data, to the plural actuators and the pieces of performance data to the electronic tone generator.

In case where the electric tone is to be produced, the piece of performance data is transferred to the electronic tone generating system for producing the electric tone, and the driving signal is supplied to the actuator so as weakly to move the associated manipulator. The moved manipulator also weakly actuates the mechanical tone generating system. As a result, any acoustic tone is not produced. However, the human beings feel the electric tones as if they are produced in response to the movements of other manipulators.

In case where the acoustic tone is to be produced, the driving signal is produced on the basis of the piece of performance data, and is supplied to the actuator. The actuator makes the other manipulator travel on the trajectory over the certain point so that the mechanical tone generator produces the acoustic tone.

A time lag is unavoidable due to the propagation of pieces of performance data through the communication channel and actuation of other manipulators. The delay canceller is provided in association with at least one of the information processing system, electronic tone generating system and controlling system so as to reduce the time lag.

In case where the delay canceller is provided only for the electronic tone generating system, the delay canceller cancels at least the delay, which is due to the actuation of other manipulators and actuation of mechanical tone generator.

In case where the delay canceller is provided only for the information processing system, the information processing unit presumes the generation of acoustic tones before the actual generation of acoustic tones on the basis of physical quantity, and the pieces of performance data expressing the presumed generation of acoustic tones are transmitted to the slave musical instrument. The controlling system of slave musical instrument produces the driving signal on the basis of the pieces of performance data, and supplies the driving signals to the actuators so as to move the other manipulators. Although the time lag is introduced, the pieces of performance data are transmitted to the slave musical instrument in advance of actual tone generation so that the time lag is at least partially or perfectly cancelled. If the user wishes to hear the electric tones, the pieces of performance data are supplied to the electronic tone generating system for the generation of electric tones, and the driving signal is supplied to the actuator for moving the other manipulators to the extend that the acoustic tone is not generated.

In case where the delay canceller is provided for both of the information processing system and controlling system, the information processing unit presumes the movements of other manipulators on the basis of the physical quantity, and the pieces of performance data expressing the presumed movements are transmitted to the slave musical instrument so as to make the controlling system reproduce the movements through the other manipulators. Since the pieces of performance data express the presumed movements in advance of the actual movements of manipulators, the time lag is partially or perfectly cancelled. The delay canceller similarly cancels the time lag through the information processing system, electronic tone generating system and controlling system.

As will be appreciated from the foregoing description, the time lag is cancelled by virtue of the delay canceller so that the electric tones and/or movements of other manipulators are well synchronized with the movements of plural manipulators. In case where human players are fingering different parts of a music tune on the musical instruments, which serve as both of the master musical instrument and slave musical instrument, the audience feels the music tune performed concurrently on both of the musical instruments.

In the following description, term "front" is indicative of a position closer to a player, who is sitting on a stool for fingering, than a position modified with term "rear". A line drawn between a front position and a corresponding rear position extends in a "fore-and-aft direction", and the fore-and-aft direction crosses a "lateral direction" at right angle. An "up-and-down direction" is perpendicular to a plane defined by the fore-and-aft direction and lateral direction.

Term "locus" is indicative of a series of values of key position where the key passes, and term "trajectory" means a series of values of key position varied together with time, i.e., relation between the series of value and time.

First Embodiment

System Configuration

Referring first to FIG. 1 of the drawings, a music performance system embodying the present invention largely comprises plural automatic player pianos PA and PB and a communication network such as, for example, internet N. The automatic player pianos PA and PB are connectable with the internet N, and pieces of music data are transferred between the automatic player pianos PA and PB.

Each of the automatic player pianos PA and PB includes an acoustic piano 1A or 1B equipped with keys 4A or 4B and strings 4A or 4B, a communication system 15A or 15B, an electronic tone generating system 16A or 16B, an automatic playing system 18A or 18B and a music data producing system 19A or 19B. The communication system 15A or 15B, electronic tone generating system 16A or 16B, automatic playing system 18A or 18B and music data generator 19A or 19B are installed inside the acoustic piano 15A or 15B, and acoustic piano tones and electronic tones are produced through vibrations of the strings 4A or 4B of acoustic piano 15A or 15B and through the electronic tone generating system 16A or 16B, respectively.

A human player A or B fingers a music tune on the keys 4A or 4B of acoustic piano 1A or 1B for producing the acoustic piano tones through the vibrations of strings 4A or 4B, and the automatic playing system 18A or 18B drives the acoustic piano 1A or 1B without the fingering of human player A or B for producing the acoustic piano tones also through the vibrations of strings 4A or 4B.

While the human player A or B is fingering a music tune on the acoustic piano 1A or 1B, the music data producing system 19A or 19B monitors the acoustic piano 1A or 1B, and produces music data codes expressing the pieces of music data. The music data codes are supplied from the music data producing system 19A or 19B to the communication system 15A or 15B in a real-time fashion. The communication systems 15A and 15B are connected to the internet N, and the music data codes are transferred from the communication system 15A or 15B to the other communication system 15B or 15A through the internet N. Upon reception of music data codes, the music data codes are transferred from the communication system 15B or 15A to the electronic tone generating system 16B or 16A, and the electronic tones are produced through the electronic tone generating system 16B or 16A.

The music data codes are further transferred from the communication system 15B or 15A to the automatic playing system 18B or 18A, and the automatic playing system 18B or 18A moves the keys 1Ba or 1Aa as if a human player depresses and releases them. However, the automatic playing system 18B or 18A prevents the acoustic piano 1B or 1A from generation of acoustic piano tones. Thus, although the keys 1Ba or 1Aa are moved, only the electronic tones are produced through the automatic player piano PB or PA.

The acoustic piano 1A or 1B introduces time lag between the fingering and the generation of acoustic piano tones. However, the electronic tones are free from the time lag due to the mechanical linkwork of acoustic piano 1B or 1A. For this reason, the timing to generate the electronic tones through the electronic tone generating system 16B or 16A is closer to the timing to generate the acoustic piano tones through the acoustic piano 1B or 1A than the timing to produce the acoustic piano tones through the slave musical instrument of prior art music performance system.

While both players A and B are fingering on the acoustic pianos 1A and 1B, respectively, the acoustic piano tones are produced through the vibrations of strings 4A in response to the fingering on the keys 1Aa and through the vibrations of strings 4B in response to the fingering on the keys 1Ba, and the music data codes expressing the fingering on the keys 1Aa and the music data codes expressing the fingering on the other keys 1Ba are transmitted from the communication system 15A to the other communication system 15B and from the communication system 15B to the communication system 15A, respectively. As a result, the acoustic piano tones and electronic tones are produced in both of the automatic player pianos PA and PB as if both players A and B perform a music tune in piano duet on each of the automatic player pianos PA and PB.

Since the automatic player piano 1A, communication system 15A, electronic tone generating system 16A, automatic playing system 18A and music data producing system 19A are similar to the automatic player piano 1B, communication system 15B, electronic tone generating system 16B, automatic playing system 18B and music data producing system 19B, respectively, it is possible to make the components of automatic player piano PA and the components of automatic player piano PB alternate in certain contexts in the following description. When a component is alternative, the component is labeled with a reference numeral without "A" and "B". For example, in case where the keys 1Aa and keys 1Ba alternate in a context, "A" and "B" are deleted from the references 1Aa and 1Ba. For example, the keys of any one of the automatic player pianos PA and PB are labeled with "1*a*". On the other hand, when description is made on the components of either automatic player piano PA or PB, the reference numerals are accompanied with "A" or "B". For example, the electronic tone generating system of automatic player piano PA is labeled with "16A", and the electronic tone generating system of automatic player piano PB is labeled with "16B".

Automatic Player Piano

Figure 2:
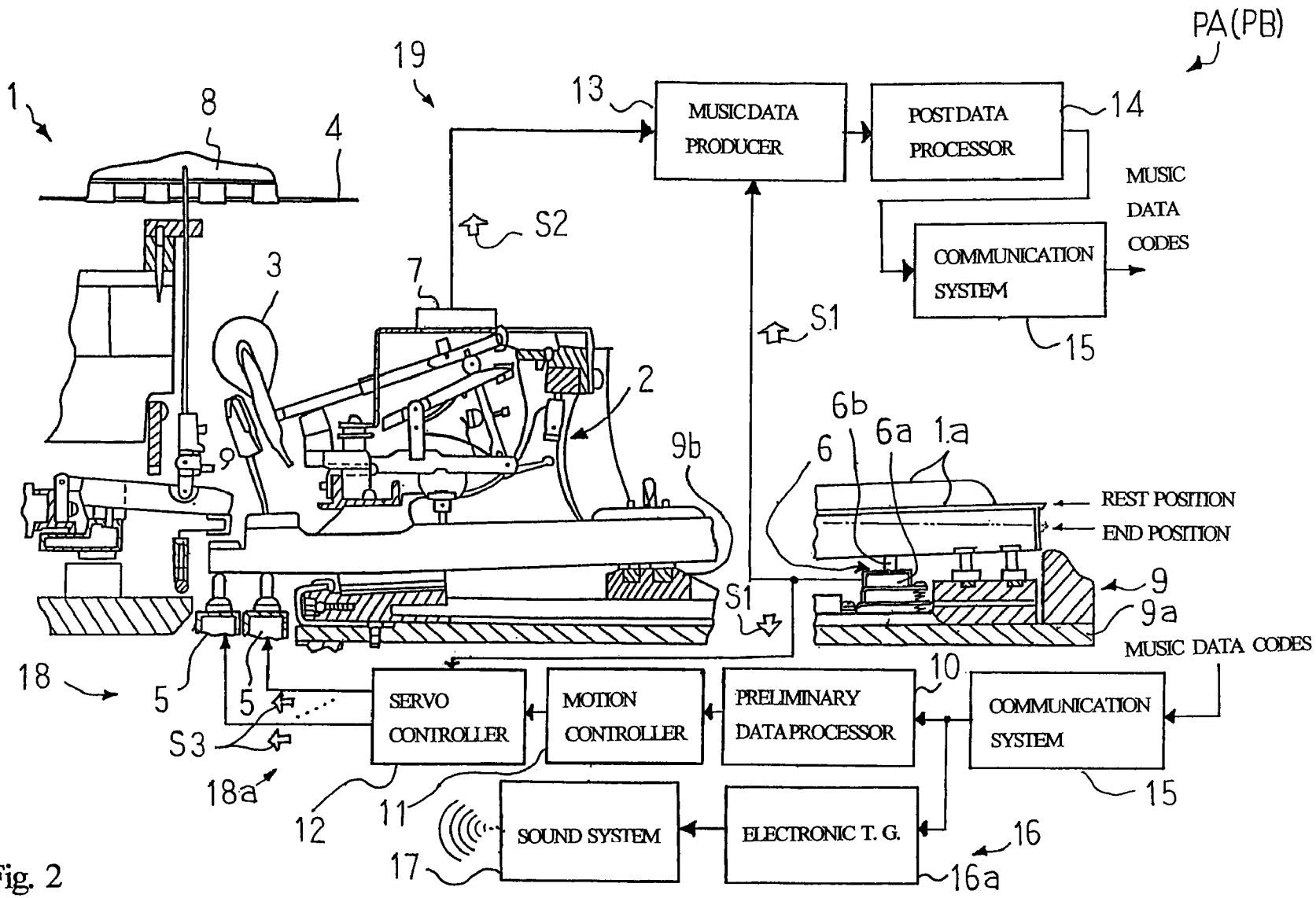
FIG. 2 is a cross sectional view showing the structure of an acoustic piano and configurations of other systems incorporated in an automatic player piano.

Turning to FIG. 2 of the drawings, the structure of acoustic piano 1, system configuration of electronic tone generating system 16, functions of automatic playing system 18 and functions of music data producing system 19 are illustrated. As described hereinbefore, the acoustic piano 1, electronic tone generating system 16, automatic playing system 18 and music data producing system 19 stands for any one of the acoustic pianos 1A and 1B, any one of the electronic tone generating systems 16A and 16B, any one of the automatic playing systems 18A and 18B and any one of the music data producing systems 19A and 19B, respectively.

The acoustic piano 1 includes the array of keys 1*a*, action units 2, an array of hammers 3, strings 4, damper units 8 and a piano cabinet 9. The array of keys 1*a* is mounted on a key bed 9*a*, which forms a bottom part of the piano cabinet 9, and the action units 2, hammers 3, strings 4 and damper units 8 are provided inside the piano cabinet 9.

In this instance, eighty-eight keys 1*a* are incorporated in the array. The keys 1*a* pitch about on a balance rail 9*b*. While the human player A or B and automatic playing system 18 do not exert any force on the keys 1*a*, the keys 1*a* stays at rest positions. When the human player A or B or automatic playing system 18 exert force on the keys 1*a*, the front portions of keys 1*a* are sunk toward end positions, and, accordingly, the rear portions of keys 1*a* are lifted. When the keys 1*a* are found at the rest position, keystroke is zero. The end positions are spaced from the rest positions by 10 millimeters. In other words, when the keys 1*a* reach the end positions, the keystroke is 10 millimeters. Thus, the keystroke is a length from the rest positions to arbitrary key positions on the loci.

The human player A or B and automatic playing system 18 give rise to the movements of keys 1*a* toward the end positions, and the action is referred to as "depressing". The human player A or B and automatic playing system 18 further give rise to the movements of keys 1*a* toward the rest positions, and the action is referred to as "release". Each of the keys 1*a* keeps and varies the key position in performance and automatic playing.

Each of the keys 1*a* usually has four phrases, the stay at the rest position, movement toward the end position, stay at the end position and movement toward the rest position, and, accordingly, the key trajectory is dividable into a stationary part at the rest position, a moving part toward the end position, a stationary part at the end position and a moving part toward the rest position. The moving part toward the end position and moving part toward the rest position are respectively referred to as "a reference forward key trajectory" and a "reference backward key trajectory." The stationary part at the end position and stationary part at the rest position are respectively referred to as a "stationary trajectory".

The keys 1*a* are arranged in the lateral direction, and are linked with the action units 2 at the intermediate portions thereof and damper units 8 at the rear portions thereof. While force is being exerted on the front portions of keys 1*a* by the human player A or B or on the rear portions by the automatic playing system 18, the keys 1*a* travel from rest positions to end positions along respective loci, and the keys 1*a* actuate the associated action units 2.

The action units 2 are further linked with the hammers 3, and the hammers 3 are rotatably supported by action brackets. For this reason, the movements of keys 1*a* are transmitted through the action units 2 to the hammers 3, and give rise to rotation of the hammers 3 through escape between the action units 2 and the hammers 3. The hammers 3 are opposed to the strings 4, and give rise to vibrations of the strings 4 at the end of rotation. The human player A or B and the automatic playing system 18 drive the hammers 3 for the rotation by depressing and releasing the keys 1*a*.

The keys 1*a* make the associated damper units 8 spaced from and brought into contact with the strings 4 depending upon the key positions on the loci. While the damper units 8 are being held in contact with the strings 4, the strings 4 are prohibited from the vibrations. When the damper units 8 are spaced from the strings 4, the strings 4 are permitted to vibrate. The depressed keys 1*a* firstly make the associated damper unit 8 spaced from the strings 4, and, thereafter, cause the hammers 3 driven for rotation. When the human player A or B releases the depressed keys 1*a*, the released keys 1*a* starts backwardly to travel on the loci. The released keys 1*a* pass through certain points on the loci. Then, the damper units 8 brought into contact with the vibrating strings 4, and make the vibrations decayed.

The human player A or B performs a music tune on the acoustic piano 1 as follows. While all of the keys 1*a* are staying at the rest positions, the hammers 3 are spaced from the associated strings 4, and the damper units 8 are held in contact with the strings 4 as shown in FIG. 2. When the human player starts his or her performance, he or she selectively depresses the keys 1*a* and releases the depressed keys 1*a*.

The human player A or B is assumed to depress one of the keys la, the depressed key 1*a* starts to travel on the locus thereof. While the depressed key 1*a* is traveling on the locus toward the end position, the depressed key 1*b*/1*c* causes the damper unit 8 to be spaced from the associated strings 4, and the strings 4 gets ready to vibrate. The depressed key 1*a* further actuates the associated action unit 2. The actuated action unit 2 makes the hammer 3 driven for rotation toward the associated string 4. The hammer 3 is brought into collision with the string 4 at the end of rotation, and gives rise to vibrations of the string 4. The vibrating string 4 in turn gives rise to the vibrations of a sound board, which forms a part of the piano cabinet 9, and an acoustic piano tone is radiated from the acoustic piano 1. The hammer 3 rebounds on the string 4, and is softly landed on the back check.

The loudness of acoustic piano tone is proportional to the velocity of hammer 3 immediately before the collision with the string 4. The human player A or B strongly depresses the black keys 1*a* so as to produce the acoustic piano tones at large loudness. On the other hand, the human player A or B gently depresses the keys 1*a* for the acoustic piano tones at small loudness.

After the generation of acoustic piano tone, the human player A or B releases the key 1*a*. Then, the released key 1*a* starts backwardly to travel on the locus. The released key 1*a* permits the damper 8 to move toward the vibrating string 4, and is brought into contact with it. Then, the vibrations are decayed, and the acoustic piano tone is extinguished. The released key 1*a* further permits the action unit 2 to return to the rest position.

The automatic playing system 18 includes a controlling system 18*a*, which is labeled with 18Aa or 18Ba in FIG. 1, solenoid-operated key actuators 5 and key sensors 6. The controlling system 18*a* has information processing capability, and the solenoid-operated key actuators 5 and key sensors 6 are connected to the controlling system 18*a*. The solenoid-operated key actuators 5 are laterally arranged in staggered fashion under the rear portions of keys 1*a*, and are respectively associated with the keys 1*a*. The controlling system 18*a* gives rise to the movements of keys 1*a* by means of the solenoid-operated key actuators 5, and causes the keys 1*a* to travel on the loci. The key sensors 6 are provided under the front portions of keys 1*a*, and are respectively associated with the keys 1*a*. The key sensors 6 are of the type optically converting the keys position on the entire loci to key position signals S1, and a photo-coupler 6*a*, which is mounted on the key bed 9*a*, and an optical modulator 6*b*, which is fitted to the lower surface of associated key 1*a*, form in combination each of the key sensors 6. While the keys la are traveling along their loci between the rest positions and the end positions, the optical modulators 6*b* make the amount of incident light varied depending upon the current key positions, and the incident light is converted to photo current, which forms the key position signals S1.

Figure 3:
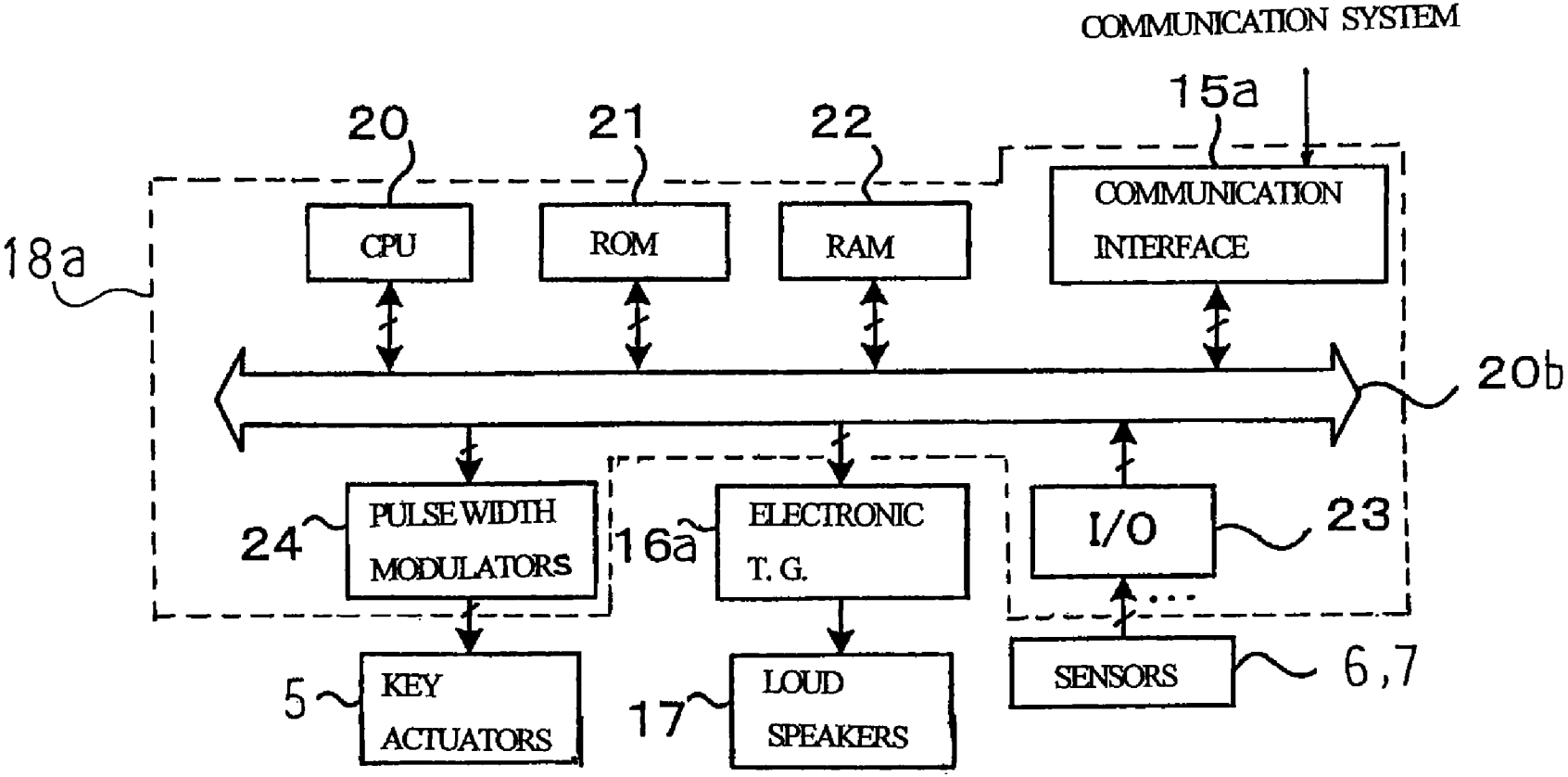
FIG. 3 is a block diagram showing the system configuration of a controlling system incorporated in the automatic player piano.

The system configuration of controlling system 18*a* is illustrated in FIG. 3. The controlling system 18*a* includes a central processing unit 20, which is abbreviated as "CPU", peripheral processor (not shown), a read only memory 21, which is abbreviated as "ROM", a random access memory 22, which is abbreviated as "RAM", a communication interface 15*a*, other interfaces 23, pulse width modulators 24 and a shared bus system 20*b*. The central processing unit 20 and other system components 21, 22, 15*a*, 23 and 24 are connected to the shared bus system 20*b* so that the central processing unit 20 is communicable with the other system components 21, 22, 15*a*, 23 and 24 through the shared bus system 20*b*.

The central processing unit 20, read only memory 21, random access memory 22 and interfaces 15*a*/23 are shared with the music data producing system 19, communication system 15 and electronic tone generating system 16.

The central processing unit 20 is an origin of the information processing capability. A computer program is stored in the read only memory 21, and runs on the central processing unit 20 so as to accomplish various tasks as will be described hereinlater in detail. The random access memory 22 serves as a working memory for the central processing unit 20, and a key index register, flags and internal clocks are defined in the working memory.

The communication interface 15*a* interconnects the communication system 15 and the controlling system 18*a*. The communication system 15 includes a transmitter and a receiver. The music data codes are loaded in and unloaded from packets as a payload by the central processing unit 20, and the packets are delivered to and received from the internet N through the communication system 15.

The other interfaces 23 serve as a MIDI (Musical Instrument Digital Interface) and signal interfaces for hammer sensors 7 and the key sensors 6. The MIDI interface is well known to persons skilled in the art. Each of the signal sensors has an analog-to-digital converter and a data buffer. Hammer position signals S2 and the key position signals S1 are selectively supplied to the signal interfaces, and the discrete values on these signals S1/S2 are converted to key position data codes and hammer position data codes. The key position data codes and hammer position data codes are temporarily stored in the data buffers, and the central processing unit 20 periodically fetches pieces of key position data expressing a value of current key position and pieces of hammer position data expressing a value of current hammer position from the data buffers. The pieces of key position data and pieces of hammer position data are accumulated in the random access memory 22 for analysis.

The pulse width modulators are responsive to pieces of control data, which are supplied from the central processing unit 20, so as to adjust driving pulse signals S3 to a target value of the amount of mean current or a target value of the duty ratio of pulse train serving as the driving pulse signals S3. The driving signal S3 flows through the solenoid-operated key actuator 5, and creates magnetic field. The strength of magnetic field and, accordingly, the force exerted on the rear portion of key 1*a* are proportional to the amount of mean current. For this reason, the central processing unit 20 controls the magnitude of force exerted on the rear portions of keys 1*a* by means of the pulse width modulators 24.

The electronic tone generating system 16 includes an electronic tone generator 16*a* and a sound system 17. The music data codes are sequentially supplied to the electronic tone generator 16*a*, and the electronic tone generator 16*a* produces an audio signal on the basis of the music data codes. The audio signal is supplied to the sound system 17, and is converted to the electronic tones through the sound system 17.

The music data codes are prepared in accordance with the MIDI protocols, and tones to be produced and tones to be decayed are specified in the note-on message and note-off message. The note-on message contains pieces of music data expressing the note-on event, note number assigned to the tone to be produced and velocity expressing the loudness of the tone. The eighty-eight keys 1*a* are assigned different note numbers so that the controlling system 18*a* can identify the keys 1*a* to be driven with the note numbers. On the other hand, the note-off message contains pieces of music data expressing the note-off event and note number assigned to the tone to be decayed. The time period between a note event, i.e., the note-on event or note-off event and the next note event is indicative of a piece of duration data, and pieces of duration data are mixed in the pieces of music data.

The electronic tone generator 16*a* has a waveform memory (not shown), and pieces of waveform are specified with the music data code. The pieces of waveform data are read out from the waveform memory, and the audio signal is formed from the pieces of waveform data. An envelope is given to a digital audio signal. An envelope is given to the digital audio signal, and the digital audio signal is converted to the audio signal, which is supplied to the sound system. Since the electronic tone generator 16*a* is well known to the persons skilled in the art, no further description is hereinafter incorporated for the sake of simplicity.

Turning back to FIG. 2, the music data producing system 19 includes the controlling system 18*a*, key sensors 6 and hammer sensors 7. The controlling system 18*a* and key sensors are shared between the automatic playing system 18 and the music data producing system 19, and are described in conjunction with the automatic playing system 18. The hammer sensors 7 are of the type optically converting the current hammer position to the key position signals S2 as similar to the key position sensors 6.

Computer Program

The computer program, which is installed in the controlling system 18*a*, is broken down into a main routine program and subroutine programs. While the main routine program is running on the central processing unit 20, users communicate with the controlling system 18*a* through a suitable man-machine interface (not shown) such as, for example, a touch-panel display unit.

Several sub-routine programs are assigned to an automatic playing, a music data generation during a performance on the automatic player piano PA or PB and a communication through the internet N. These sub-routine programs are available for a performance in solo or ensemble on the automatic player piano PA or PB. Another subroutine program runs on the central processing system for the music session, and the above-described subroutine programs are selectively called under the supervision of the sub-routine program for the music session. When a user selects his or her favorite operation from a job menu on the man-machine interface (not shown), the main routine program starts to branch to the sub-routine program through timer interruptions. Upon expiry of the time period, the central processing unit 20 returns from the subroutine program to the main routine program. Thus, the entry into the subroutine program and return to the main routine program are repeated.

A task is accomplished through execution of the subroutine program for the automatic playing, and is corresponding to functions of the controlling system 18A. The functions are referred to as a "preliminary data processor" 10, a "motion controller" 11 and a "servo controller" 12.

While the subroutine program for the automatic playing is running on the central processing unit 20, the music data codes are periodically supplied from the communication system 15, a data storage facility (not shown) or another MIDI musical instrument to the preliminary data processor 10, and pieces of individualized performance data are supplied from the preliminary data processor 10 to the motion controller 11, from which the pieces of key trajectory data are supplied to the servo controller 12 for servo control on the solenoid-operated key actuators 5.

The pieces of performance data are individualized so as to be optimum for the automatic player piano PA or PB in the preliminary data processor 10. The pieces of performance data are subjected to the individualization in the post data processor 10, and the pieces of individualized performance data are produced through the preliminary data processor 10.

The pieces of individualized performance data are conveyed from the preliminary data processor 10 to the motion controller 11.

The motion controller 11 determines the reference forward key trajectory for each of the keys 1*a* to be depressed and the reference backward key trajectory for each of the keys 1*a* to be released. However, the motion controller 11 determines a reference forward silent trajectory and a reference backward silent trajectory instead of the reference forward key trajectory and reference backward key trajectory for the music session.

As described hereinbefore, term "key trajectory" means a series of values of key position varied with time. A reference point is a unique key position on the locus of each key. If a depressed key 1*a* passes through the reference point at a reference key velocity, the depressed key 1*a* makes the associated hammer 3 brought into collision with the string 4 at a target hammer velocity. Since the loudness of acoustic tone is proportional to the target hammer velocity, it is possible to produce the acoustic tone at a target value of loudness by adjusting the reference key velocity at the reference point to a certain value. The depressed keys 1*a* pass through the reference points at target values of reference key velocity in so far as the depressed keys 1*a* travel on the reference forward key trajectories. Thus, the motion controller 11 makes it possible to produce the acoustic tones at target values of loudness by using the reference forward key trajectories.

The reference backward key trajectory is produced so as to make the acoustic tones timely decayed. As described hereinbefore, when the damper units 8 are brought into contact with the vibrating strings 4, the acoustic tone is decayed. The time period from the previous key event to a note-off event is defined in a piece of performance data, and the reference backward key trajectory leads the released keys 1*a* to the key positions on the loci where the released keys 1*a* make the associated damper units 8 timely brought into contact with the vibrating strings 4. Thus, the motion controller 11 makes the acoustic tones timely decayed by using the reference backward key trajectories.

As described hereinbefore, the reference key velocity is proportional to the hammer velocity immediately before the collision with the strings 4 and, accordingly, the loudness of acoustic tones. If the reference key velocity is less than a threshold, the depressed keys 1*a* weakly drive the associated hammers 3, and the hammers 3 can not reach the associated strings 4. For this reason, although the keys 1*a* are moved on the loci, any acoustic tone is not generated. The reference forward silent trajectory makes the depressed keys 1*a* pass through the reference point at a small value of reference key velocity less than the threshold. Thus, the motion controller 11 causes the keys 1*a* to travel on the loci without any generation of acoustic piano tones. The reference key velocity for the reference forward silent trajectory is determined through experiments by the manufacturer, and pieces of control data, which express values of the reference key velocity for the individual keys 1*a*, are stored in the read only memory 21 before delivery to users.

The reference backward silent trajectory leads the released keys 1*a* to initial key positions. Since any acoustic tone is generated, the reference backward silent trajectory is not expected to make the released keys 1*a* pass through the key positions on the loci at the timing to decay the acoustic piano tones.

The stationary trajectories are inserted between the reference forward key trajectories and the reference backward key trajectories and also between the reference forward silent trajectories and the reference backward silent trajectories.

The pieces of key trajectory data express any one of the reference forward key trajectory, reference backward key trajectory, reference forward silent trajectory and reference backward silent trajectory, and each piece of key trajectory data expresses a target key position on the locus. The pieces of key trajectory data are periodically supplied from the motion controller 11 to the servo controller 12.

When the piece of key trajectory data reaches the servo controller 12, the servo controller fetches a piece of key position data expressing the current key position from the random access memory 22, and determines a target key velocity and a current key velocity from a series of values of piece of key trajectory data and a series of values of piece of key position data. The servo controller 12 compares the current key position and current key velocity with the target key position and target key velocity to see whether or not any difference is found between the current key position and the target key position and between the current key velocity and the target key velocity. If a difference or differences are found, the servo controller 12 varies the mean current or duty ratio of the driving signal S3. The strength of magnetic field around the solenoids is controllable with the means current so that the plungers of solenoid-operated key actuators 5 are accelerated or decelerated. Thus, the servo controller 12 forces the keys 1*a* to travel on the reference forward key trajectory, reference backward key trajectory, reference forward silent trajectory or reference backward silent trajectory.

While the motion controller 11 is periodically supplying the pieces of key trajectory data expressing the reference forward silent trajectory, the servo controller 12 causes the solenoid-operated key actuator 5 to force the key 1*a* to travel on the reference forward silent trajectory. However, the reference key velocity is so small in value that the action unit 2 makes the hammer 3 slowly rotate. For this reason, the hammer 3 does not reach the associated string 4. As a result, although the key 1*a* is moved, any acoustic tone is not generated.

Another task is also accomplished through execution of the subroutine program for the music data generation, and is corresponding to functions of the controlling system 18A. The functions are referred to as a "music data producer" 13 and a "post data processor" 14.

While the subroutine program for the music data generation is running on the central processing unit 20, the music data producer 13 intermittently transfers the pieces of key position data and pieces of hammer position data from the interfaces 23 to the random access memory 22 so as to accumulate a series of values of key position for each of the keys 1*a* and a series of values of hammer position for each of the hammers 3, and determines a time to initiate the depressing, a key velocity for each depressed key la, a time to strike the string 4 with each hammer 3, a time to initiate the release, a key velocity for each released key 1*a* so as to produce the pieces of performance data. The pieces of performance data express the MIDI messages and a time period from each event such as the note-on event or note-off event to the next event.

The pieces of performance data are transferred from the music data producer 13 to the post data processor 14, and are normalized in the post data processor 14. Each of the automatic player pianos PA and PB unavoidably has individualities due to the deviation of sensors 6 and 7 from the strict target positions, difference in structure of acoustic pianos 1, tolerance in machining and so forth. In order to make the music data codes shared between the automatic player pianos PA and PB, it is necessary to eliminate the individuality from the pieces of performance data. For this reason, the post data processor 14 is provided for the pieces of performance data to be normalized. After the normalization, the pieces of performance data are stored in the music data codes in accordance with the MIDI protocols, and the music data codes are supplied to the communication system 15, electronic tone generator 16*a*, data storage facility (not shown) for recording or a MIDI musical instrument through a MIDI cable.

While the subroutine program for communication is running on the central processing unit 20, the music data codes are loaded in packets as a payload, and the packets are sequentially delivered to the internet N. The music data codes are unloaded from the packets through the execution of subroutine program for communication.

Figure 4:
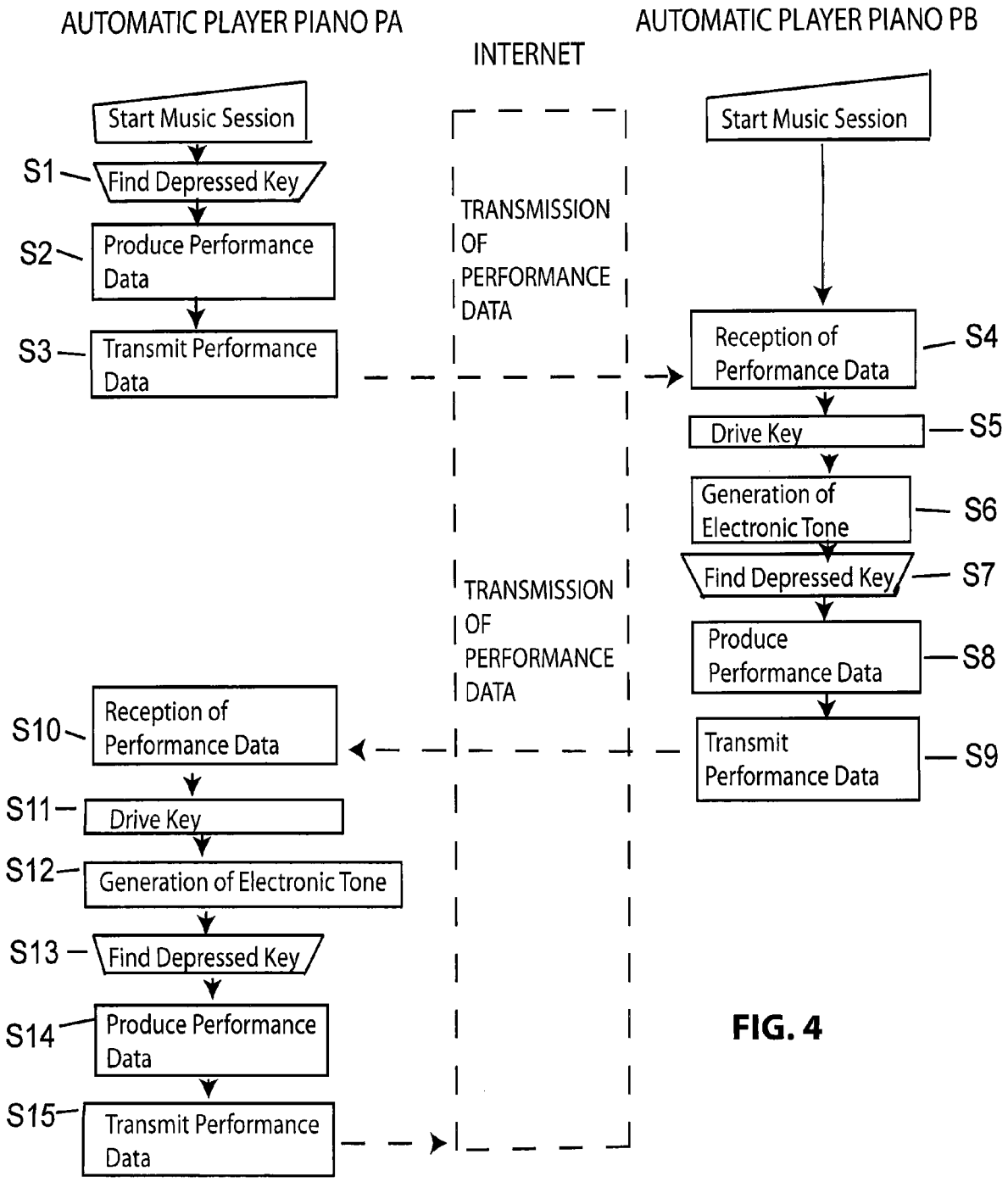
FIG. 4 is a flowchart showing a job sequence in a music session.

The subroutine program for the music session will be hereinlater described in detail. FIG. 4 shows the jobs on the controlling systems 18*a* for the music session. As described hereinbefore, the subroutine program for music session supervises the subroutine program for the automatic playing, subroutine program for music data generation and sub-routine program for communication. In this instance, the subroutine program for music session contains a job to select the electronic tone generating system 16 so that the received music data codes are transferred to the electronic tone generator 16*a*. The users connect the automatic player pianos PA and PB to the internet N, and select the music session from the job menu on the man-machine interfaces. Then, the main routine programs start periodically to branch to the subroutine programs for music session.

Behavior in Music Session

While the subroutine program for music session is running on the central processing unit 20 of controlling system 18Aa and the central processing unit 20 of controlling system 18Ba, the music session proceeds as shown in FIG. 4. In this instance, if the users concurrently depress the keys 1*a*, which are assigned a certain key number, of the automatic player pianos PA and PB, respectively, the controlling systems 18Aa and 18Ba give the priority to the key movements depressed by user's fingers, and the keys 1*a* are driven by the solenoid-operated key actuators 5 after return to the rest positions.

The user A is assumed to depress one of the keys 1Aa. The depressed key 1Aa actuates the associated action unit 2, and the action unit 2 gives rise to the rotation of hammer 3 through the escape. The hammer 3 is brought into collision with the string 4 at the end of rotation, and the acoustic piano tone is generated through the vibration of string 4. Moreover, the key sensor 6A reports the current key position, the value of which is varied together with time, to the signal interface 23A, and the central processing unit 20A accumulates the pieces of key position data in the random access memory 22A. The central processing unit 20A finds the depressed key 1Aa through the analysis on the pieces of key position data as by step S1, and the music data codes, which express the note-on event, key number, key velocity and time period from the previous key event, are produced through the music data producer 13A and post data processor 14A as by step S2.

Subsequently, the music data codes are loaded in the packet, and the packet is transmitted from the communication system 15A through the execution of subroutine program for communication as by step S3.

The packet arrives at the communication system 15B of automatic player piano PB, and the music data codes are unloaded from the packet through the execution of subroutine program for communication as by step S4. The pieces of performance data, which are stored in the music data codes, are processed through the subroutine program for automatic playing as by step S5, and are transferred from the communication system 15B to the electronic tone generating system 16B.

The piano controller 10B individualizes the pieces of performance data so as to supply the pieces of individualized performance data to the motion controller 11B. The motion controller 11B analyzes the pieces of individualized performance data, and determines reference forward silent trajectory on the basis of the pieces of individualized performance data. The pieces of key trajectory data, which express the reference forward silent trajectory and reference backward silent trajectory, are periodically supplied from the motion controller 11B to the servo controller 12B, and the servo controller 12B forces the key 1Ba to travel on the reference forward silent trajectory and reference backward silent trajectory as by step S5. Thus, the key 1Ba is moved without any acoustic piano tone, and the key 1Ba starts to return immediately after the arrival at the end position or a certain key position on the way to the end position.

In case where a pianist fingers on the automatic player piano PB with the accompaniment of another pianist on the automatic player piano PA, the motion controller 11B supplies the pieces of key trajectory data expressing the reference forward silent trajectory to the servo controller 12B, and the pieces of key trajectory data expressing the reference backward silent trajectory is given from the motion controller 11B to the servo controller 12B at appropriate timing.

On the other hand, the electronic tone generator 16Ba produces the audio signal on the basis of the music data code, and supplies the audio signal to the sound system 17B so as to produce the electronic tone as by step S6.

The movements of key 1Ba and electronic tone notify the user B of the fingering on the automatic player piano PA. Then, the user B starts to depress the key 1Ba corresponding to the depressed key 1Aa. The depressed key 1Ba actuates the action unit 2B, and the actuated action unit 2B gives rise to the hammer rotation. The hammer 2B is brought into collision with the string 4B, and the acoustic piano tone is generated through the vibration of string 4.

While the key 1Ba is being depressed, the key sensor 6B makes the key position signal S1 varied together with the current key position as by step S7, and the central processing unit 20B accumulates the pieces of key position data in the random access memory 22B. The pieces of performance data expressing the note-on key event are produced through the music data producer 13B, and are normalized through the post data processor 14B. The pieces of normalized performance data are stored in the music data codes as by step S8. The music data codes are loaded in a packet, and the packet is transmitted from the communication system 15B to the communication system 15A through the execution of subroutine program for communication as by step S9.

Upon reception of the packet as by step S10, the music data codes are unloaded from the packet in the communication system 15A, and the music data codes are supplied in parallel from the communication system 15A to the automatic playing system 18A and electronic tone generating system 16A. The automatic playing system 18A forces the key 1Aa to travel on the reference forward silent trajectory and reference backward silent trajectory without generation of acoustic piano tone as by step S11, and the electronic tone is generated through the electronic tone generating system 16A as by step S12. Thus, the user A confirms the fingering of user B through the movements of key 1Aa and electronic tone.

When the user A depresses the key 1Aa for the next tone on the music score, the jobs at steps S1, S2 and S3 are repeated as by steps S13, S14 and S15. The steps S1 to S12 are repeated on the automatic player pianos PA and PB until the end of performance. Of course, when the user B depresses the keys 1Ba without the reception of music data codes from the automatic player piano PA, the electronic tone is produced in the automatic player piano PA, and the corresponding key 1Aa is moved without generation of the acoustic piano.

The jobs S1 to S6 are carried out so as to reenact the performance on the automatic player piano PA through the other automatic player piano PB, and is referred to as the first phrase of music session. On the other hand, the jobs S7 to S12 are carried out so as to make the user A confirm the fingering of user B through the automatic player piano PA, and is referred to as the second phrase of music session. The first phrase and second phrase are desirable for a remote music lesson. In FIG. 1, real lines are indicative of the first phrase, and broken lines are indicative of the second phrase. The music session proceeds to the end. When the users A and B inform the controlling systems 18A and 18B of exhibit from the music session through the man-machine interfaces, the main routine programs do not branch to the subroutine programs for music session anymore.

In case where the users A and B finger on the different parts of a music tune, respectively, the music tune is performed in piano duet on both of the automatic player pianos PA and PB. The music session may be partially constituted by only the first phrase or second phase.

As will be understood from the foregoing description, although the acoustic piano tones are produced through the own automatic player piano PA or PB, the performance on the other automatic player piano PB or PA is reproduced through the electronic tone generating system 16A or 16B. It is not necessary to take the time lag due to the activation of action units 2 and hammer rotation into account. The electronic tones are merely delayed due to the communication through the internet N. For this reason, the music session smoothly proceeds without serious delay. Although the key movements without generation of acoustic piano tones, i.e., silent key movements are delayed from the generation of electronic tones due to the actuation of action units 2 and rotation of hammers 3, the time lag between the generation of electronic tones and the silent key movements is not serious so that the users A and B and audience do not feel the silent key movements unnatural.

Second Embodiment

System Configuration of Music Performance System

Figure 5:
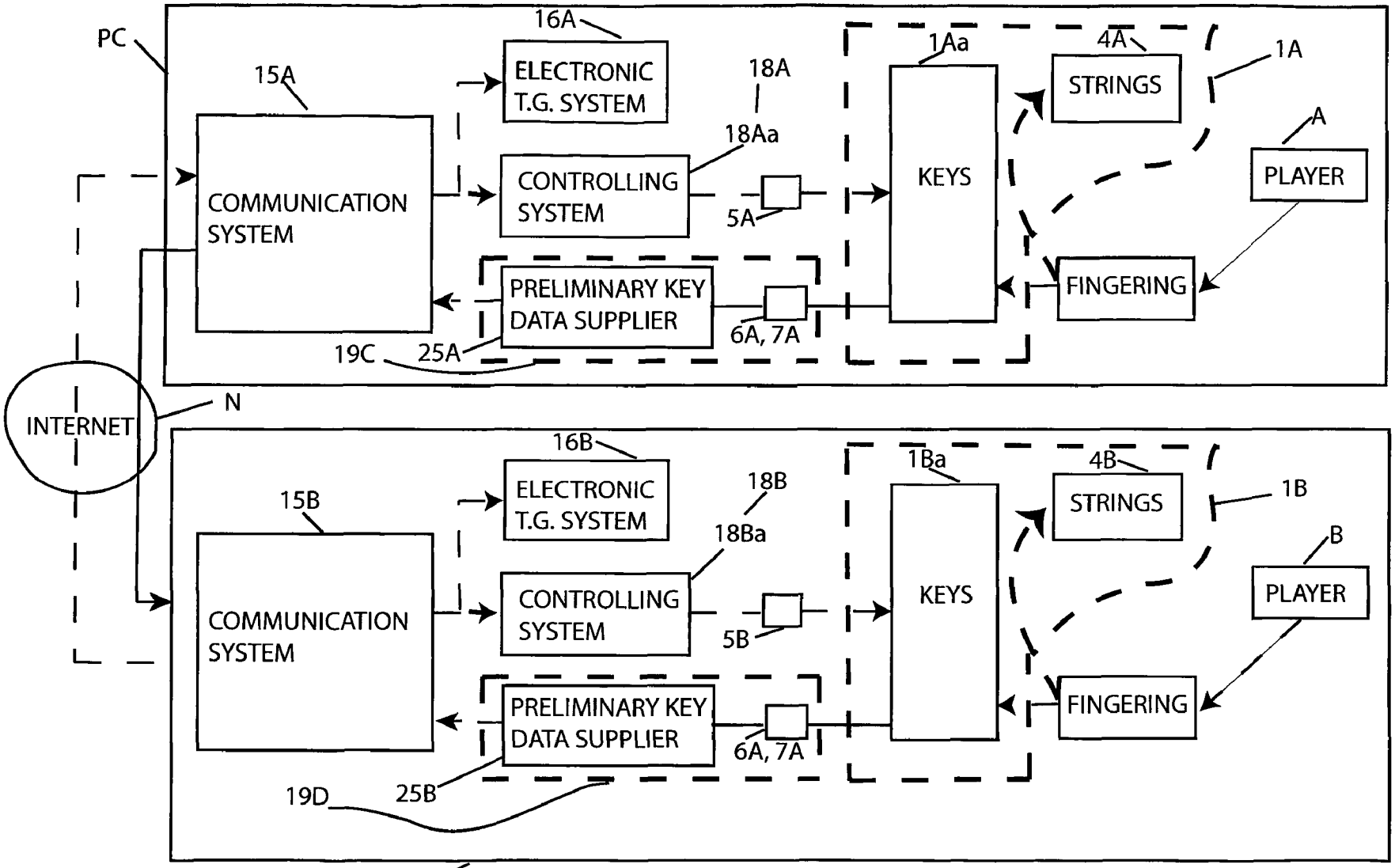
FIG. 5 is a block diagram showing the system configuration of another music performance system of the present invention.

Turning to FIG. 5 of the drawings, another music performance system embodying the present invention also comprises automatic player pianos PC and PD and the internet N.

The automatic player pianos PC and PD are similar to the automatic player pianos PA and PB except for music data producing system 19C and 10D. For this reason, the other component parts of automatic player piano PC and the other component parts of automatic player piano PD are labeled with references designating the corresponding component parts of automatic player piano PA and the corresponding component parts of automatic player piano PB without detailed description for avoiding repetition. Furthermore, component parts of acoustic pianos of automatic player pianos and the system components of controlling systems 18Aa and 18Ba are labeled with references designating the corresponding component parts of acoustic piano shown in FIG. 2 and the corresponding system components of controlling system shown in FIG. 3.

Computer Program

A computer program, which is installed in the controlling system 18*a*, is also broken down into a main routine program and several subroutine programs. The main routine program and subroutine program for communication are similar to those of the computer programs installed in the controlling systems 18*a* of automatic player pianos PA and PB.

The subroutine program for automatic playing is simpler than the subroutine programs for automatic playing installed in the automatic player pianos PA and PB. Although the reference forward silent trajectory and reference backward silent trajectory are determined in the music session for the silent key movements in the automatic player pianos PA and PB, the reference forward key trajectory and reference backward key trajectory are produced in the music session through the music performance system implementing the second embodiment. In other words, the automatic playing systems 18A and 18B of automatic player pianos PC and PD drive the keys 1Aa and 1Ba to generate the acoustic piano tones in the music session. Accordingly, while the subroutine program for music session is running on the central processing unit 20, the music data codes are transferred from the communication system 15A or 15B to the automatic playing system 18A or 18B, and are not supplied to the electronic tone generating system 16A or 16B.

Behavior in Music Session

The music data producing system 19C includes the key sensors 6, hammer sensors 7, a music data producer (not shown), a post data processor (not shown) and a preliminary key data supplier 25, i.e., 25A or 25B. The music data producer and post data processor are same as the music data producer 13 and post data processor 14, and, for this reason, the music data producer and post data processor of music data producing system 19C or 19D are hereinafter labeled with the reference numerals 13 and 14, i.e., 13A or 13B and 14A or 13B. The preliminary key data supplier 25A or 25B is connected in parallel to the music data producer 13 and post data processor 14, and the pieces of key position data are processed through the preliminary key data supplier 25A or 25B in the music session. The preliminary key data suppliers 25A and 25B presume target key positions and target key velocity at a time later than the present time by the communication delay time D. The preliminary key data supplier 25A or 25B is indicative of a function of the music data producing system 19C or 19D, and is realized through execution of a part of the subroutine program for music data generation.

The preliminary key data suppliers 25A and 25B aim at acceleration of generation of acoustic piano tones. When the users A and B selects the music session from the job menu, the central processing units 20A and 20B reiterate a job sequence in the subroutine program for music data generation, and produce pieces of key motion data on the basis of the pieces of key position data accumulated in the random access memories 22A and 22B. Each piece of key motion data expresses the key number assigned to the moved key 1Aa or 1Ba, a lapse of time from the initiation of music session, the presumed key position and the presumed key velocity. The pieces of key motion data are supplied from the preliminary key data supplier 25A or 25B to the communication system 15A or 15B, and are transmitted to the other communication system 15B or 15A as the payload of packets. The format for key motion data is disclosed in Japan Patent Application laid-open No. 2006-178197.

Figure 6:
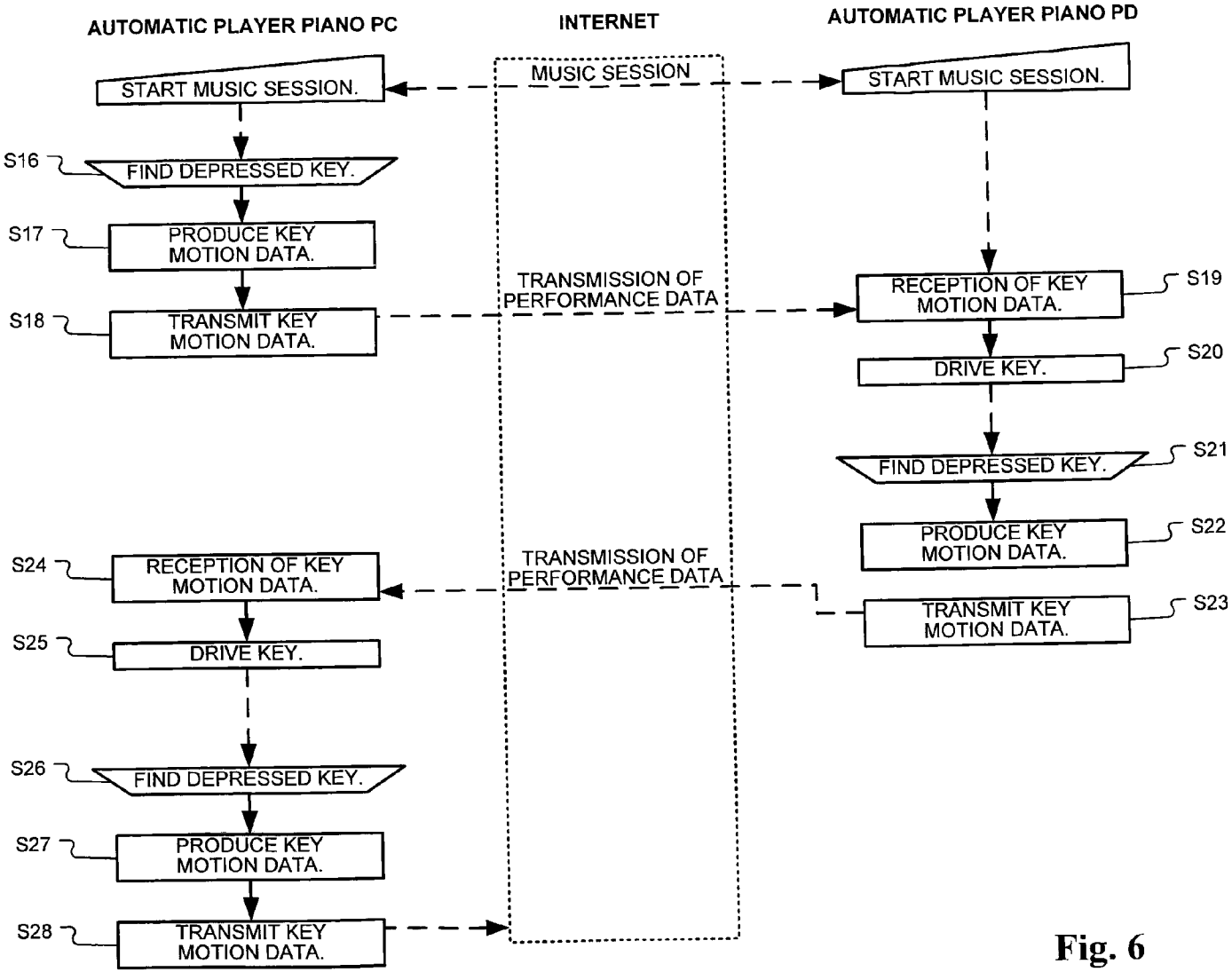

FIG. 6 shows a sequence of jobs for the music session. The users A and B select the music session from the job menu, and the main routine program starts periodically to branch to the subroutine program for music session.

While the music session is proceeding, the user A sequentially depresses the keys 1Aa. When the user A depresses one of the keys 1Aa, the associated key sensor 6A varies the key position signal S1 depending upon the current key position as by step S16, and the piece of key position data, which expresses the current key position of the depressed key 1Aa, is accumulated in the random access memory 22A. Then, the preliminary key data supplier 25A starts to produce the piece of key motion data on the basis of the piece of key position data as by step S17. While the preliminary key data supplier 25A is producing the piece of key motion data, a communication time lag D is taken into account, and the piece of key motion data makes the automatic playing system 18B drives the corresponding key 1Ba in such a manner that the communication time lag is compensated. The piece of key motion data is transmitted from the communication system 15A to the communication system 15B through the internet N as by step S18.

The piece of key motion data arrives at the communication system 15B as by step S19, and the communication time lag D is introduced between the transmission and the reception due to propagation of the packet. The controlling system 18Ba analyzes the piece of key motion data, and starts to drive the key 1Ba, which is corresponding to the depressed key 1Aa, to produce the acoustic piano tone as by step S20. Since the piece of key motion data expresses the presumed key position and presumed key velocity at the time later than the present time by the communication time lag D, the corresponding key 1Ba is forced to travel on the reference forward key trajectory, and reference backward key trajectory same as the locus of key 1Aa so that acoustic piano tone is produced through the acoustic piano 1B concurrently with the acoustic piano tone produced through the acoustic piano 1A.

In the similar manner, while the music session is proceeding, the user B sequentially depresses the keys 1Ba. When the user B depresses one of the keys 1Ba, the associated key sensor 6B reports the current key position to the preliminary key data supplier 25B as by step S21, and the preliminary key data supplier 25B produces the piece of key motion data on the basis of the piece of key position data as by step S22. The piece of key motion data is supplied from the communication system 15B to the communication system 15A through the internet N as by step S23, and is received at the communication system 15A as by step S24. The communication time lag D is introduced between the transmission and the reception. The automatic playing system 18A drives the key 1Aa, which is corresponding to the depressed key 1Ba, for producing the acoustic piano tone concurrently with the acoustic piano tone produced through the acoustic piano 1A as by step S25.

The report of current key position, production of key motion data and transmission of key motion data are repeated in the automatic player piano PA as by S26, S27 and S28, and are also repeated in the other automatic player piano PB.

Figure 7:
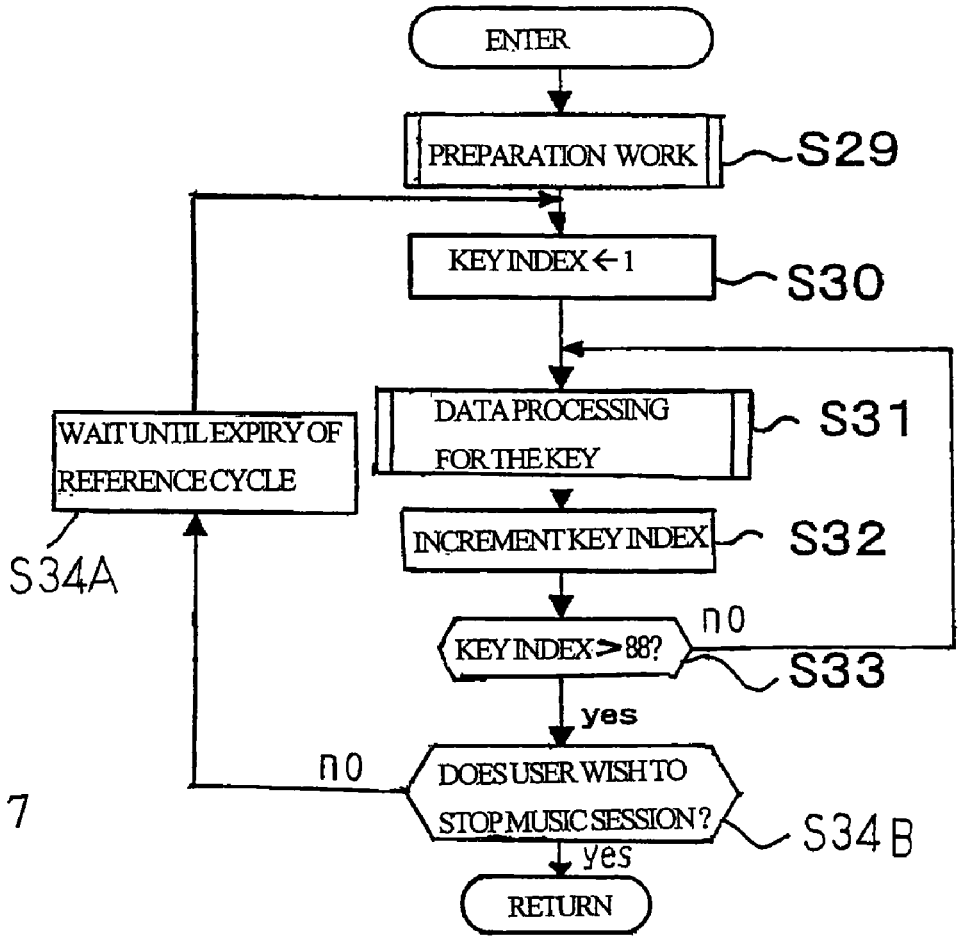
FIG. 7 is a flowchart showing a job sequence in the music session.

FIG. 7 shows a job sequence in the subroutine program for music session executed in both of the automatic player pianos PA and PB. In the following description, term "reference cycle time T" is defined as a unit time period with which the communication time lag D is measured. Term "reference cycle" is a time frame equal in length to the reference cycle time. Information processing on all the keys 1*a*, i.e., eighty-eight keys is completed within the reference cycle time T.

When the users PA and PB select the music session from the job menu, the main routine program starts periodically to branch to the subroutine program for music session through timer interruptions. The description is hereinafter focused on the automatic player piano PA.

The central processing unit 20A carries out a preparation work as by step S29 so as to determine the communication time lag D. The preparation work S29 is hereinlater detailed with reference to FIG. 8.

Subsequently, the central processing unit 20A writes key number "1" into the key index register as by step S30, and, thereafter, carries out a data processing for the key 1Aa assigned the key number stored in the key index register as by step S31. The key number stored in the key index register is hereinafter referred to as "key index". The data processing at step S31 is hereinlater described in detail with reference to FIG. 9.

Subsequently, the central processing unit 20A increments the key index by one as by step S32, and checks the key index register to see whether or not the key index is greater than 88 as by step S33. Since the acoustic piano 1A has eighty-eight keys 1Aa, the answer is given negative "no" before completion of data processing on all the keys 1Aa. On the other hand, the positive answer "yes" is indicative of the completion of repetition of data processing at step S31 for all the keys 1Aa.

When the answer at step S33 is given negative "no", the central processing unit 20A returns to step S31. Thus, the central processing unit 20A repeats the jobs at step S31 for the eighty-eight keys 1Aa within the single reference cycle time period T.

The central processing unit 20A reiterates the loop consisting of steps S31 to S33 for all of the keys 1Aa. After the data processing on the eighty-eighth key 1Aa was completed at step S31, the answer at step S33 is changed to the positive answer "yes".

The central processing unit 20A checks the random access memory 22A to see whether or not the user A has already instructed the controlling system 18Aa to stop the data processing for the music session as by step S34B. While the user A is fingering on the acoustic piano 1A, the answer at step S34B is given negative "no". With the negative answer "no", the central processing unit 20A proceeds to step S34A, and waits for the expiry of reference cycle time period T. Upon expiry of the reference cycle time period T, the central processing unit 20A returns to step S30. Thus, the central processing unit 20A reiterates the loop consisting of steps S30 to S34B in the performance on the acoustic piano 1A, and repeatedly carries out the data processing for the eighty-eight keys 1Aa.

On the other hand, when the user A instructs the controlling system 18Aa to stop the music session, a piece of control data expressing user's instruction is stored in the random access memory 22A, and the answer at step S34B is changed to positive answer "yes". With the positive answer "yes" at step S34B, the control returns to the main routine program, and the main routine program does not branch to the subroutine program anymore.

Figure 8:
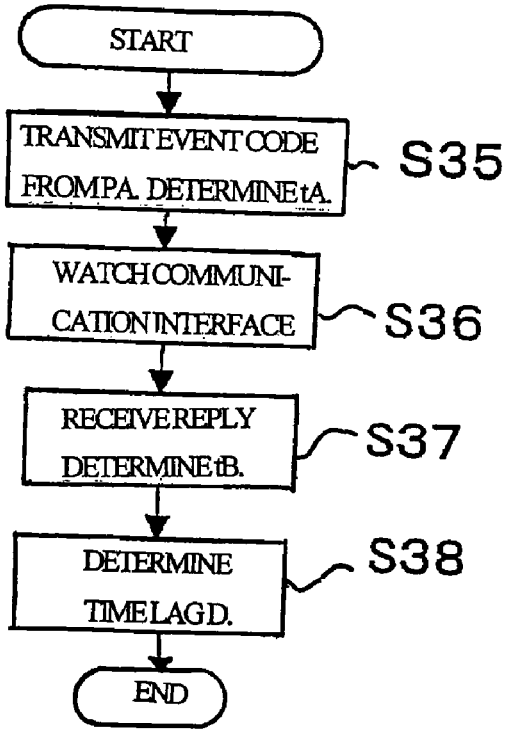
FIG. 8 is a flowchart showing a job sequence in a preparation work for the music session.

Turning to FIG. 8, when the central processing unit 20A starts the preparation work at step S29, the central processing unit 20A transfers an event data code to the communication system 15A so as to transmit a packet, in which the event data code is loaded, from the communication system 15A to the communication system 15B through the internet N, and reads a transmitting time tA on an internal clock as by step S35. The number of reference cycles is counted with the internal clock. The central processing unit 20A stores the transmitting time tA in the random access memory 22A.

Subsequently, the central processing unit 20A starts to watch the communication interface 15A, and waits for a replay. When the event data code arrives at the communication system 15A, the central processing unit 20B transfers the event data code to the communication system 15B so as to transmit a packet, in which the event data code is loaded, from the communication system 15B to the communication system 15A as the replay.

When the reply arrives at the communication system 15A, the event data code is taken into the controlling system 18Aa as by step S37, and reads the reception time tB on the internal clock as by step S37. The event data code is reciprocally propagated through the internet N between the communication system 15A and the communication system 15B. As a result, the difference between the transmission time tA and the reception time tB is twice longer than the communication time lag D.

Finally, the central processing unit 20A divides the difference between the transmission time tA and the reception time tB by 2 so as to determine the communication time lag D as by step S38. Thus, the communication time lag is determined through the preparation work S29 prior to the music session.

Figure 9A:
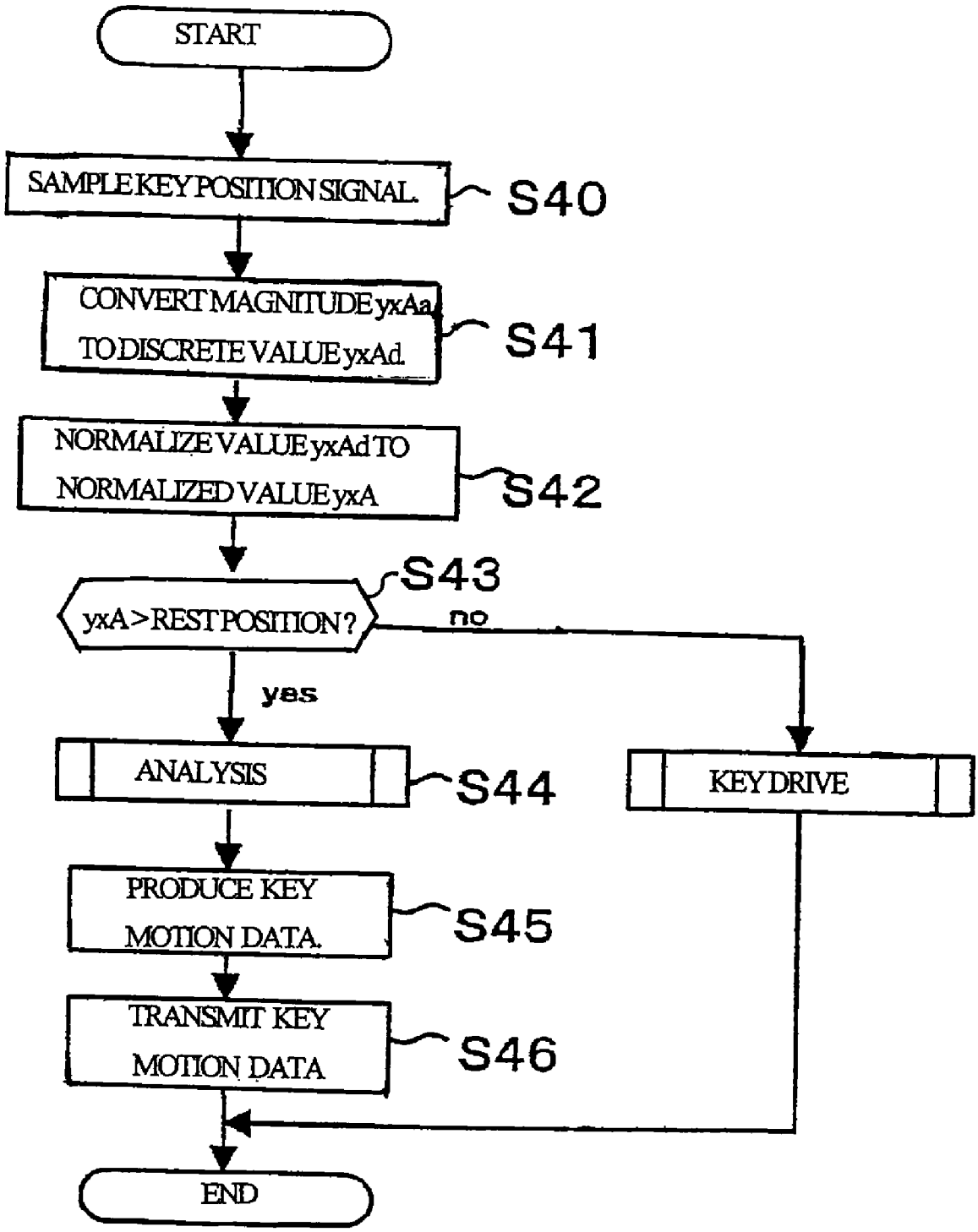
FIGS. 9A and 9B are flowcharts showing job sequences incorporated in a subroutine program for the music session.
Figure 9B:
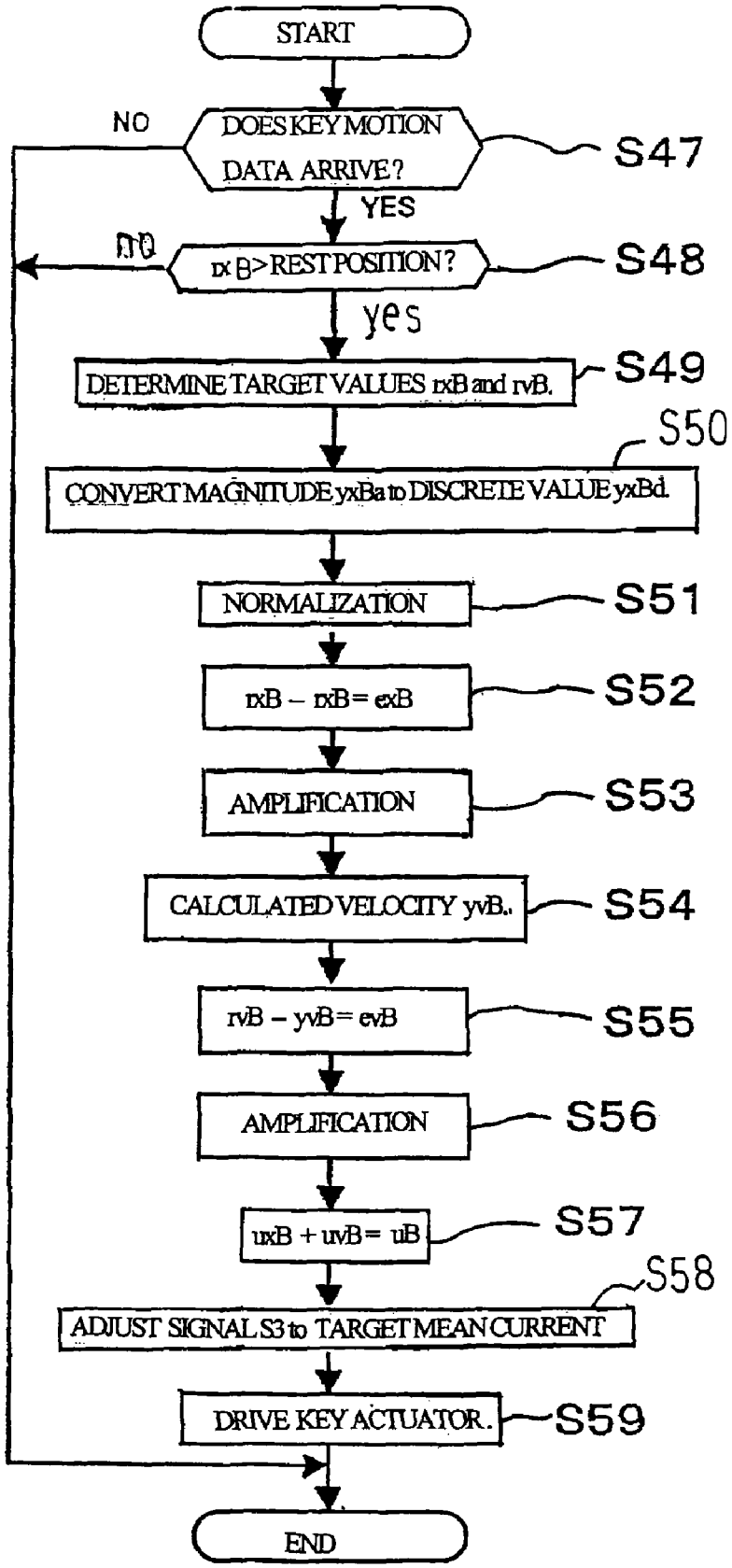

FIGS. 9A and 9B show job sequences during the data processing at step S31. When the user A or B depresses the key 1Aa or 1Ba, the job sequence shown in FIG. 9A is traced. On the other hand, when the music data code arrives at the communication system 15A or 15B, the central processing unit 20A or 20B traces the job sequence shown in FIG. 9B. The controlling system 15A or 15B completes either job sequence for each key 1Aa or 1Ba within the reference cycle time T. The job sequences shown in FIGS. 9A and 9B are hereinlater described. Description is made on the assumption that the key motion data is supplied from the automatic player piano PA to the other automatic player piano PB.

Figure 10:
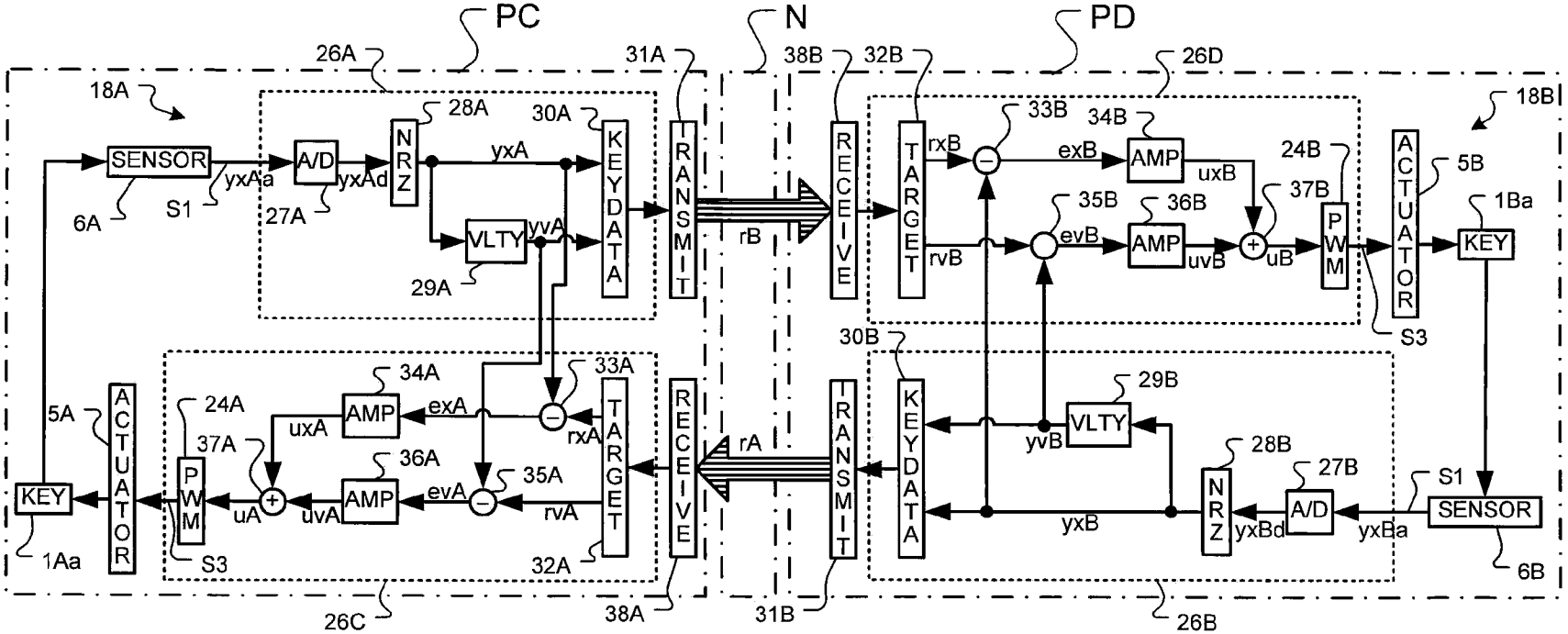
FIG. 10 is a block diagram showing functions of automatic player pianos in the music session.

The music data processing systems 19C and 19D realize functions shown in FIG. 10. The keys 1Aa, solenoid-operated key actuators 5A, key sensors 6A and controlling system 18A are the hardware of automatic player piano PC which relate to the music session. Similarly, the keys 1Ba, solenoid-operated key actuators 5A, key sensors 6A and controlling system 18B participate in the music session as the hardware of automatic player piano PD. The functions are broken down into "production of key motion data 26A or 26B" and "reproduction of key movements 26C or 26D".

The user A is assumed to start to depress one of the keys lAa of the automatic player piano PC in the music session. The key 1Ba is assumed to be corresponding to the depressed key 1Aa. The associated key sensor 6A varies the key position signal S1, and the controlling system 18A starts the data processing.

The key position signal S1 is sampled, and the sampled magnitude yxAa of the key position signal S1 is converted to a discrete value yxAd. Thus, the key position signal S1 is subjected to the analog-to-digital conversion 27A.

Subsequently, an individual component due to the individuality of acoustic piano 1A is eliminated from the discrete value yxAd. In other words, the discrete value yxAd is normalized to normalized discrete value yxA, and the function of normalization is labeled with "28A". The normalized discrete value yxA have been accumulated together with the sampling time in the random access memory 22A. A normalized value yvA expressing a key velocity is determined on the basis of the normalized discrete values yxA, and the function of calculation is labeled with "29A". The piece of key motion data rB is produced from the normalized discrete value yxA expressing the normalized key position rxB, normalized discrete value yvA expressing the normalized key velocity rvB, time at which the key position signal is sampled and key number assigned to the depressed key 1Ax, and the production of key motion data is labeled with "30A".

The piece of key motion data rB is supplied to the communication system 15A, and is loaded in a packet. The packet is transmitted through the internet N to the communication system 15B. The transmission of key motion data rB is labeled with "31A".

The functions 27A, 28A, 29A, 30A and 31A are also realized in the other automatic player piano PD, and the corresponding functions are labeled with 27B, 28B, 29B, 30B and 31B, respectively, and yxBa, yxBd, yxB, yvB and rA stand for the sampled magnitude, discrete value converted from the sampled magnitude, normalized discrete value expressing the normalized key position, normalized discrete value expressing the normalized key velocity and piece of key motion data, respectively.

The packet arrives at the communication system 15B, and the piece of key motion data rB is unloaded from the packet. The reception and unloading are labeled with 38B. A target key position and a target key velocity are determined on the basis of the piece of key motion data rB. The target key position is a key position where the key 1Ba is expected to be found at the given time, and is equivalent to the presumed key position. The target key velocity is key velocity at the target key position, and is equivalent to the presumed key velocity. The target key position and target key velocity are labeled with rxB and rvB, respectively.

Since the sensor 6B monitors the corresponding key 1Ba, the key position signal S1 is periodically sampled, and the magnitude yxBa is converted to the discrete value yxBd. The discrete value yxBd is normalized to normalized discrete value yxB expressing the normalized current key position, and the normalized current key velocity is determined on the basis of the normalized discrete values yxB.

A deviation exB and a deviation evB are determined through subtractions 33B and 35B between the target key position rxB and the normalized current key position yxB and between the target key velocity rvB and the normalized current key velocity yvB, and the deviations exB and evB are multiplied by certain gains through amplifications 34B and 36B. The products uxB and uvB are added to each other so as to determine the sum uB. The addition is labeled with "37B". The sum uB is indicative of a target value of the amount of mean current. The driving signal S3 is adjusted to the target value of the amount of mean current through the pulse width modulator 24B, and is supplied to the solenoid-operated key actuator 5B. The functions 33B, 34B, 35B, 36B, 37B, 24B, 27B, 28B and 29B are corresponding to the servo controller 12 shown in FIG. 2.

The functions 38B, 32B, 33B, 34B, 35B, 36B, 37B and 24B are realized in the automatic player piano PC, and the corresponding functions are labeled with 38A, 32A, 33A, 34A, 35A, 36A, 37A and 24A, respectively.

The functions 27A to 30A, 32B to 34B, 24B, 27B to 30B, 32A to 37A and 24A are sequentially realized in the music session as shown in FIGS. 9A and 9B.

When the user A depresses one of the keys 1Aa in the music session, the associated key sensor 6A starts to vary the magnitude yxAa of key position signal S1. The analog-to-digital converter of the signal interface 23A samples the magnitude yxAa as by step S40, and converts the magnitude yxAa to the discrete value yxAd as by step S41. The central processing unit 20A eliminates the individualities of acoustic piano 1A and key sensor 6A from the discrete value yxAd so as to obtain the normalized value yxA as by step S42.

Subsequently, the central processing unit 20A checks the normalized value at the rest position to see whether or not the current normalized value yxA is greater than the normalized value at the rest position as by step S43. In this instance, while the key 1Aa is moving from the rest position toward the end position, the normalized value yxA is gradually increased. The positive answer "yes" at step S43 means that the user A has already depressed the key 1Aa. On the other hand, if the answer at step S43 is given negative "no", the user A still leaves the key 1Aa at the rest position, and the central processing unit 20A proceeds to a job sequence shown in FIG. 9B.

Since the user A depressed the key 1Aa, the answer at step S43 is given affirmative "yes", the central processing unit 20A raises a flag, and proceeds to step S44 for the analysis on the pieces of key position data for the function 29A and part of function 30A. When the key 1Aa reaches the end of released key trajectory, the flag is taken down. While the flag is rising, the central processing unit 20A ignores the answer at step S43, and proceeds to step S44.

The presumed key position rxB and presumed key velocity rvB are determined through the analysis at step S44. The analysis at step S44 is hereinlater described in detail.

Upon completion of analysis, the central processing unit 20A produces the piece of key motion data rB as by step S45, and loads the piece of key motion data rB in the packet so as to transmit the key motion data rB to the automatic player piano PD.

The job sequence shown in FIG. 9A are repeated so as periodically to supply the pieces of key motion data rB.

Even if the piece of key motion data rA arrives at the communication system 15A concurrently with the initiation of depressing, the central processing unit 20A gives the priority to user's fingering, and does not carry out the functions 32A to 37A and 24A.

The central processing unit 20B periodically checks the communication system 15B to see whether or not the packet arrives at the communication system 15B as by step S47. While the packet is propagating through the internet N, the answer at step S47 is given negative "no". Then, the central processing unit 20B immediately returns to the main routine.

When the packet arrives at the communication system 15B, the answer at step S47 is changed to the positive answer "yes". With the positive answer "yes", the central processing unit 20B compares the normalized value rxB of the key 1Ba corresponding to the depressed key lAa with the normalized value at the rest position to see whether or not the corresponding key 1Ba has already left the rest position as by step S48. If the user B has already depressed the corresponding key 1Ba, the answer at step S48 is given affirmative "no", and the central processing unit 20B immediately returns to the main routine.

When the corresponding key 1Ba is found at the rest position at the arrival of the first piece of key motion data rB, the answer at step S48 is given negative "yes", and the corresponding key 1Ba is to be driven with the solenoid-operated key actuator 5B. For this reason, the central processing unit 20B raises the flag indicative of the actuation of key 1Ba with the solenoid-operated key actuator 5B. While the flag is being raised, the central processing unit ignores the answer at step S48, and proceeds to the next step S49. The flag is taken down at the return to the rest position.

The central processing unit 20B extracts the normalized value expressing the presumed key velocity rvB and normalized value expressing the presumed key position rxV from the piece of key motion data rB at S49. The normalized values are also labeled with "rxB" and "rvB" for the sake of simplicity.

Subsequently, the magnitude yxBa of key position signal S1 is converted to the discrete value yxBd as by step S50, and the discrete value yxBd is normalized to the normalized value yxB as by step S51. The central processing unit 20B determines the positional deviation exB through the subtraction of the normalized value yxB expressing the current key position from the normalized value rxB expressing the target key position as by step S52. The positional deviation exB is amplified as by step S53.

The central processing unit 20B determines the normalized value yvB expressing the target key velocity on the basis of the normalized values yxB as by step S54, and determines the velocity deviation evB between the normalized value yvB and the normalized value rvB as by step S55. The velocity deviation evB is amplified as by step S56.

Subsequently, the central processing unit 20B calculates the sum of the positional deviation exB and velocity deviation evB so as to determine the piece of control data uB as by step S57. The piece of control data uB is supplied to the pulse width modulator 24B, and the pulse width modulator 24B adjusts the driving signal S3 to the target amount of mean current in consideration of the piece of control data uB as by step S58.

The driving signal S3 is supplied to the solenoid-operated key actuator 5B as by step S59. The solenoid-operated key actuator 5B pushes the rear portion of the corresponding key 1Ba so as to actuate the action unit 2B of acoustic piano 1B.

The job sequence shown in FIG. 9B is repeated so as to give rise to the movement of corresponding key 1Ba. The corresponding key lBa actuates the associated action unit 2B, which in turn drives the associated hammer 3B for rotation. The hammer 3B is brought into collision with the string 4B, and the acoustic tone is generated through the vibrations of string 4B. Thus, the acoustic piano tone is generated in the acoustic piano 1B without any fingering.

When the user depresses one of the keys 1Ba, the controlling system 18Ba accomplishes the jobs S40 to S46 shown in FIG. 9A, and the controlling system 18Aa accomplishes the jobs S47 to S59 shown in FIG. 9B.

As will be understood from the foregoing description, the key position of corresponding key 1Ba or 1Aa and the key velocity of corresponding key 1Ba or 1Aa are presumed for the corresponding key 1Ba or 1Aa in the preliminary key data supplier 25A or 25B of automatic player piano PC or PD, and supplies the piece of key motion data rB or rA to the other automatic player piano PD or PC. The presumed key position rxB or rxA and presumed key velocity rvB or rvA are indicative of the position and velocity of the corresponding key 1Ba or 1Aa at the time later than the pre-sent time by the communication delay time D. For this reason, even though the communication delay time D is unavoidably introduced during the propagation of piece of key motion data rB, the corresponding key 1Ba or lAa is moved concurrently with the key 1Aa or 1Ba. Thus, the communication delay time D is eliminated from between the movement of key 1Aa and the movement of corresponding key 1Ba.

Compensation of Communication Time Lag

Figure 11:
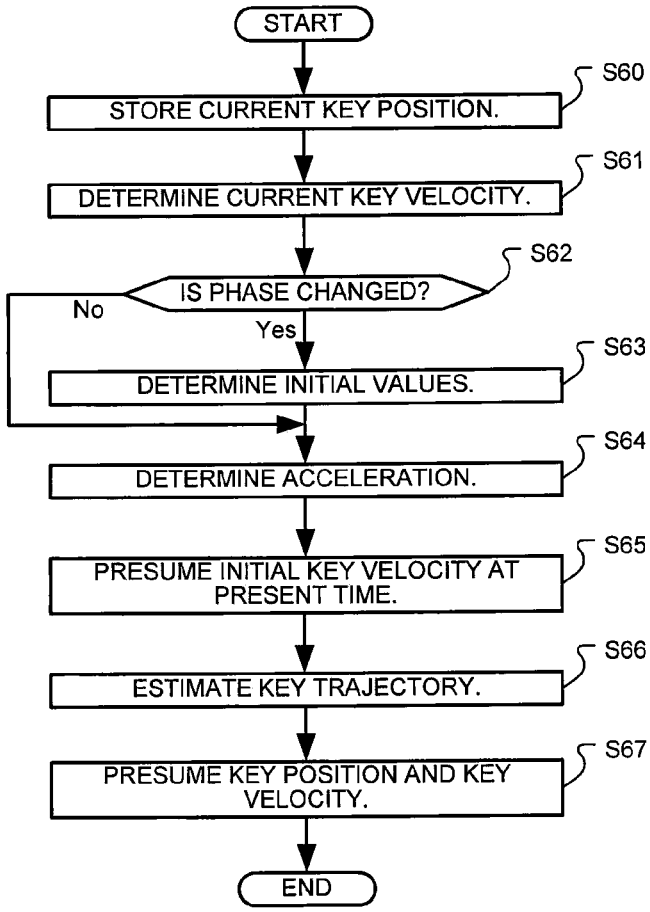
FIG. 11 is a flowchart showing a job sequence for presuming a key position and a key velocity of a corresponding key in the music session.
Figure 12:
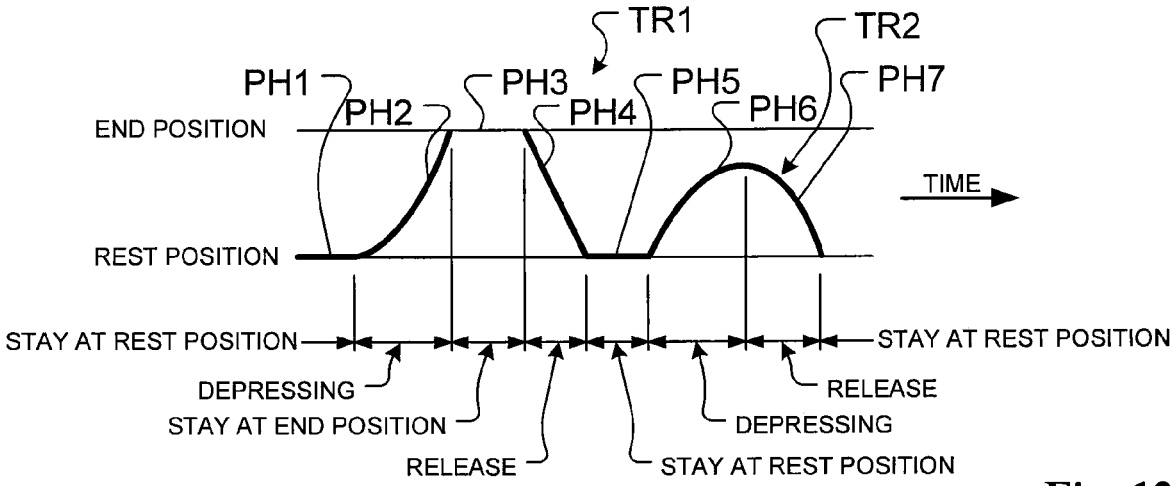
FIG. 12 is a waveform diagram showing a locus of a key in a standard fingering and a locus of the key in a half-stroke key movement.

FIG. 11 shows a job sequence corresponding to step S44, and FIG. 12 shows loci of a key of an acoustic piano. The key position and key velocity of corresponding key 1Ba or 1Aa are presumed at step S44 as follows.

A user is assumed simply to depress a key 1*a*, keep the key 1*a* at the end position for a while, release the key 1*a*, keep the key 1*a* at the rest position for a while, depress the key 1*a* and release the key 1*a* on the way to the end position as shown in FIG. 12. While the user simply is moving the key 1*a* between the rest position and the end position, the key trajectory TR1 is divided into five phrases, i.e., the stay at the reset position, depressing, stay at the end position, release and stay at the rest position. For this reason, there are four phrase boundaries. On the other hand, while the user is moving the key 1*a* through half-stroke, the key 1*a* changes the direction of movement at a certain point between the rest position and the end position, and the trajectory TR2 is divided into two phrases, i.e., release PH6 and depressing PH7. For this reason, the key trajectory TR1 has only one phrase boundary between the released phrase PH6 and the depressed phrase PH7.

The key position X[n] is expressed at time t[n] after n reference cycle times nT from the phrase boundary as $$X[n]=A[n]/2\times t[n]^2+V[n]\times t[n] \quad \text{Equation 1}$$

where A[n] is acceleration at expiry t[n] of time period equal to the n reference cycle times nT and V[n] is velocity at t[n].

A discrete value yxAd is assumed to be normalized to the normalized value yxA at step S42. The central processing unit 20A or 20B starts the job sequence shown in FIG. 11. The central processing unit 20A or 20B stores the normalized value yxA at time t[n] in a memory location assigned to the depressed key 1Aa or 1Ba as by step S60.

Subsequently, the central processing unit 20A or 20B reads out the normalized value yxA[n] at time t[n] and the previous normalized value yxA[n−1] from the random access memory 22A or 22B, and calculates the key velocity yv[n] as by step S61.

$$yv[n]=(yx[n]-yx[n-1])/T \quad \text{Equation 2}$$

Subsequently, the central processing unit 20A or 20B checks the key position yx[n] and key velocity yx[n] to see whether or not the key 1Aa or 1Ba is found at the phase boundary as by step S62.

If the key position yx[n] is changed to 0 millimeter or less than 0 millimeter, the key 1Aa or 1Ba is found at the boundary between the release phase PH4 and the stay phrase PH5 at the rest position. If the key position yx[n] is changed to 10 millimeters or greater than 10 millimeters, the key 1Aa or 1Ba is found at the boundary between the depressed phase PH2 and the stay phase PH3 at the end position. If the key velocity yv[n] has a positive value at the key position equal to zero or in the released phase PH6, the key 1Aa or 1Ba is found at the phase boundary between the stay phase PH1 at the rest position and the depressed phase PH2 or the phrase boundary between the released phrase PH7 and the next depressed phase. If the key velocity data yv[n] has a negative value at the key position equal to 10 millimeter or in the depressed phrase PH6, the key 1Aa or 1Ba is found at the phase boundary between the stay phrase PH3 at the end position and the released phrase PH4 or between the depressed phase PH6 and the released phrase PH7.

If any one of the above-described conditions is fulfilled, the answer at step S62 is given affirmative "yes", and the central processing unit 20A or 20B proceeds to the next step S63. On the other hand, if all of the above-described conditions are not fulfilled, the answer at step S62 is given negative "no", and the central processing unit 20A or 20B proceeds to step S64 without any execution at step S63.

The key 1Aa or 1Ba is assumed to be found at the phrase boundary. The central processing unit 20A or 20B gives the following initial values to the number n of reference cycle times T, key position yx[n], key velocity yv[n] and acceleration ya[n] at step S63.

$$yx0=yx[n-1]$$

$$yx1=yx[n]$$

$$n=1$$

$$yv0=0$$

$$yv1=(yx1-yx0)/T$$

$$ya0=0,$$

$$ya1=0$$

Thus, the number n of reference cycles T, key position yx[n], key velocity yv[n] and key acceleration ya[n] are reset to the initial values at the phase boundary.

Upon completion of the job at step S63 or with the negative answer "no" at step S62, the central processing unit 20A or 20B determines the acceleration ya[n] at time t[n] at step S64.

$$ya[n]=(yv[n]-yv[n-1])/T \quad \text{Equation 3}$$

The central processing unit 20A or 20B estimates the initial key velocity Vv[n] as by step S64. The central processing unit 20A or 20B estimates a key trajectory passing through the current key position yx(n) and previous key positions yx[n−1] and yx[n−2] as by step S66, and determines the initial key velocity Vv[n] from the estimated key trajectory. The initial key velocity Vv[n] is given as $$Vv[n]=\{(2\times n-1)\times yv[n-1]-(2\times n-3)\times yv[n]\}/2 \quad \text{Equation 4}$$

The key acceleration ya[n] and initial key velocity Vv[n] are stored in the certain memory location of random access memory 22A or 22B assigned to the key 1Aa or 1Ba.

Finally, the central processing unit 20A or 20B estimates the key trajectory in the present phase, and presumes the key position rx[n] and key velocity rv[n] at the time t[n+D] later than the present time t[n] by the communication time lag D as by step S67.

In detail, the central processing unit 20A or 20B sequentially reads out the values of initial key velocity Vv1, . . . And Vv[n] from the random access memory 22A or 22B, and averages the values Vv1, . . . , Vv[n], i.e., V[n]=(Vv1+ . . . + Vv[n])/n. Furthermore, the central processing unit 20A or 20B sequentially reads out the values ya[2], . . . , ya[n] of key acceleration, and averages the values as A[n]=(ya2+ . . . , + ya[n])/(n−1). Since the key trajectory X[n] in the present phrase is expressed as $X[n]=A[n]/2\times t[n]^2+V[n]\times t[n]$ (see equation 1), the key position rx[n] and key velocity rv[n] at the time t[n+D] later than the present time t[n] by the communication time lag D are given by Equations 5 and 6, respectively.

$$rx[n]=A[n]/2\times t[n+D]^2+V[n]\times t[n+D] \quad \text{Equation 5}$$

$$rv[n]=A[n]\times t[n+D]+V[n] \quad \text{Equation 6}$$

As will be understood from the foregoing description, the preliminary key data supplier 25A or 25B estimates the key trajectory before the key 1Aa or 1Ba reaches the phase boundary between the present phase and the next phase, and presumes the key position rxB or rxA and key velocity rvB or rvA on the key trajectory. The key 1Aa or 1Ba are expected to be found at key position rxB or rxA and key velocity rvB or rvA at the time later than the present time by the communication time lag D. The controlling system 18Ba or 18Aa carries out the servo control through the comparison between the presumed key position rxB/rxA and the actual key position yxB/yxA and between the presumed key velocity rvB/rvA and the actual key velocity yvB/yvA so that the key 1Ba or 1Aa are moved on the locus in synchronism with the key 1Aa or 1Ba. Thus, the communication time lag D is compensated through the data processing in the preliminary key data supplier 25A or 25B and the servo controller 12B or 12A. The users A and B can perform different parts of a music tune on both of the automatic player pianos PC and PD in good ensemble.

Figure 13:
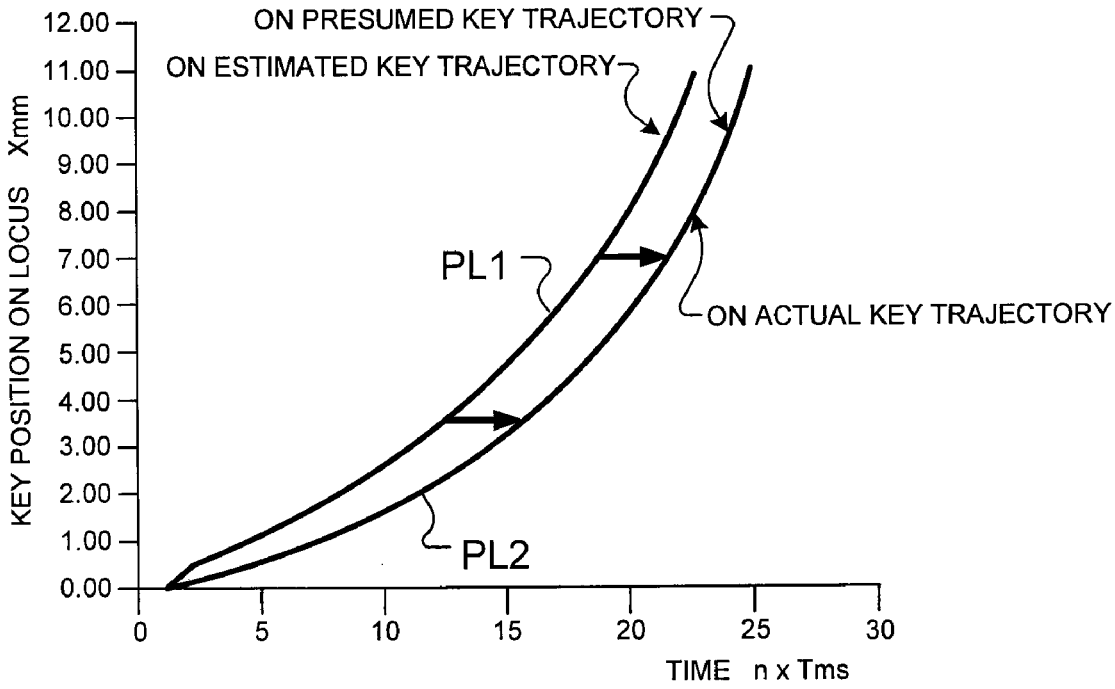
FIG. 13 is a diagram showing a key position on an estimated key trajectory, a presumed key trajectory and an actual key trajectory in terms of time.

The present inventors confirmed the synchronized key movements 1Aa and 1Ba through experiments. In the experiments, the key lBa followed the key 1Aa. The present inventors plotted the key position of key 1Aa on the estimated key trajectory X[n] expressed by equation 1, key position rxB of key 1Aa on the presumed key trajectory presumed by using equation 5 and actual key position yxB of key 1Ba as shown in FIG. 13. The estimated key trajectory was expressed by plots PL1, and the plots PL1 were close in shape to plots PL2 expressing the actual key trajectory. The difference in time between the plots PL1 and the plots PL2 was equal to the communication time lag D.

Figure 14:
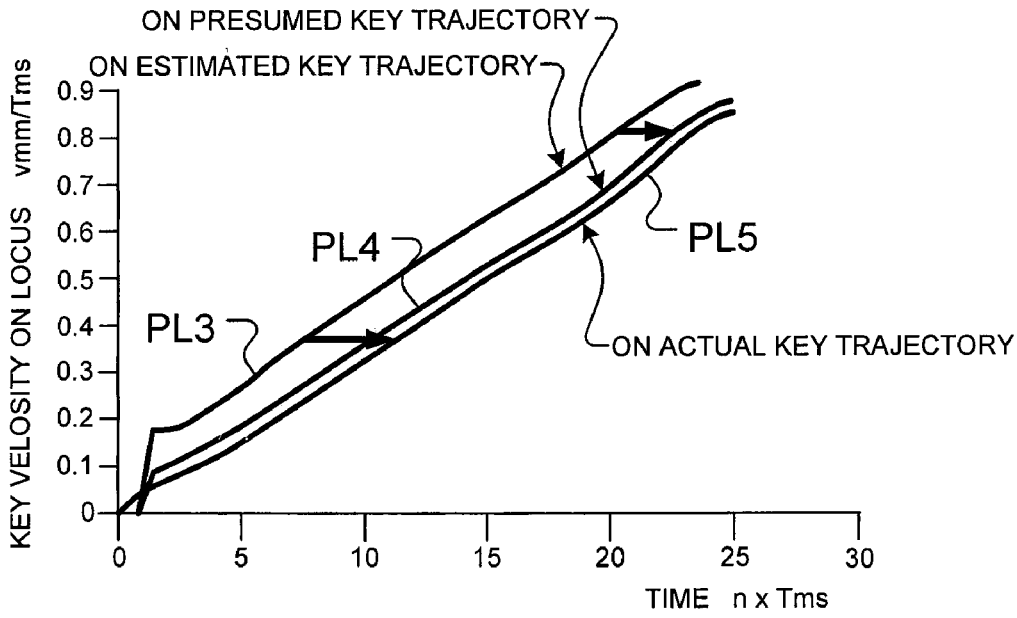
FIG. 14 is a diagram showing a key velocity on an estimated key trajectory, a presumed key trajectory and an actual key trajectory in terms of time.

Furthermore, the present inventors plotted the estimated key velocity V[n] on the estimated key trajectory, presumed key velocity rvB on the presumed key trajectory and actual key velocity yvB on the actual key trajectory as shown in FIG. 14. Plots PL3 expressing the presumed key velocity rvB were delayed from plots PL4 expressing the estimated key velocity V[n] by the communication time lag D, and plots PL5 expressing the actual key velocity yvB were close to the plots PL4. From the plots, it is understood that the key 1Ba was well synchronized with the key 1Aa.

Furthermore, the presumed key trajectory makes the timing to generate an acoustic piano tone produced through a slave musical instrument, key velocity in tone generation, timing to decay the piano tone and key velocity in decay consistent with those of a master musical instrument. The master musical instrument means the automatic player piano PC or PD on which the user A or B fingers a music tune, and the slave musical instrument means the automatic player piano PD or PC through which the acoustic piano tones are reproduced.

The phases PH6 and PH7 are determined differently from the phases PH1 to PH5 so that the presumed key trajectory expresses the difference in styles of rendition on the master musical instrument. This results in the reproduction of performance at high fidelity.

Since the acceleration A[n] is taken into account for the estimated key trajectory X[n], difference in tone color is reflected in the estimated key trajectory and, accordingly, presumed key trajectory. Thus, the acoustic piano tones reproduced through the slave musical instrument are close in tone color to the acoustic piano tones produced on the master musical instrument.

Figure 15:
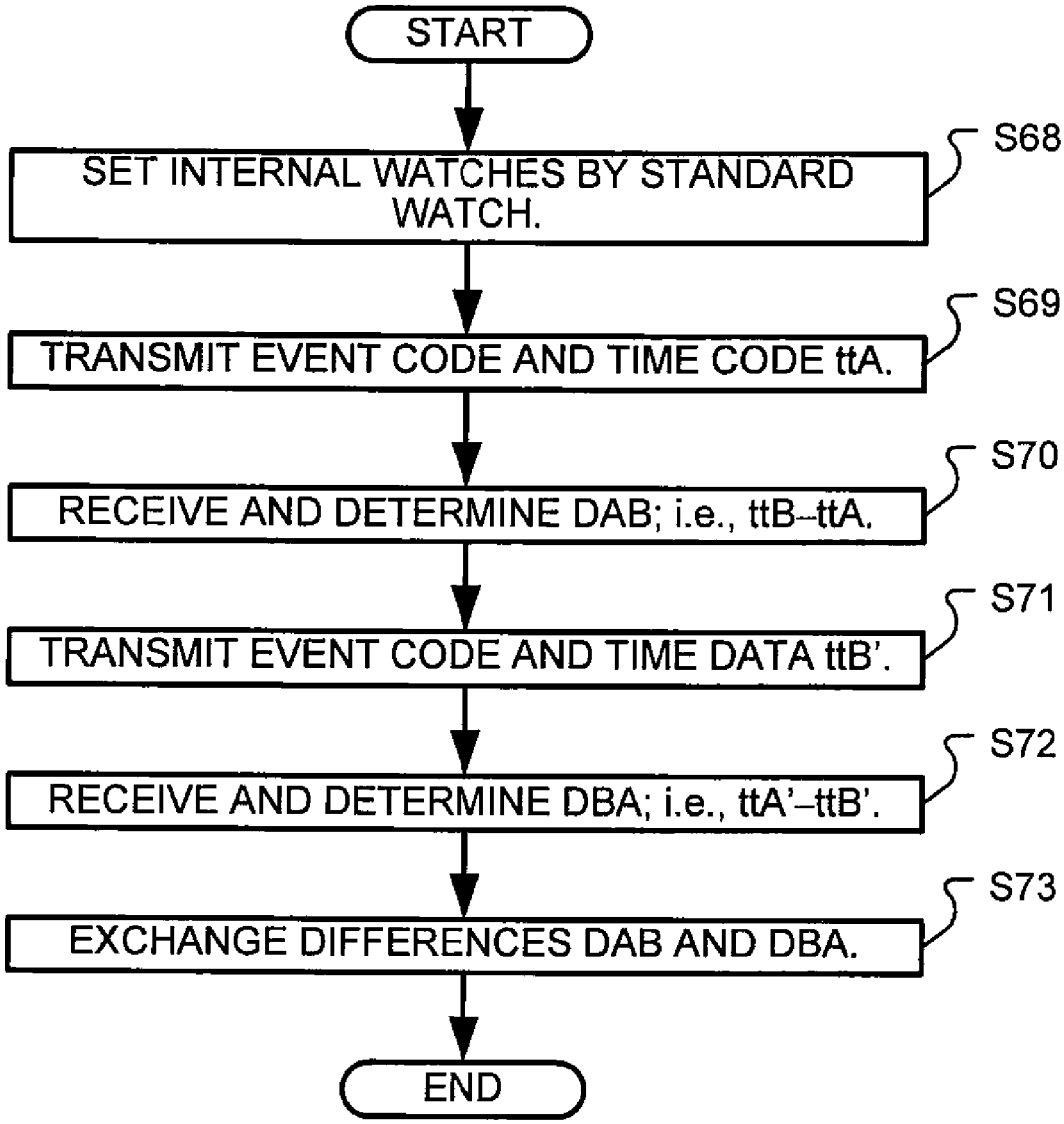
FIG. 15 is a flowchart showing a job sequence for measuring a communication time lag.

The job sequence shown in FIG. 8 may be replaced with a job sequence shown in FIG. 15. The job sequence shown in FIG. 8 is employed in automatic player pianos of a music performance system, and the automatic player pianos have internal watches, respectively. The internal watches are indicative of the year, month, day, hour, minute, second and sub-second tt. When the internal watches take a figure up from the sub-second to the second, the sub-second returns to zero, and the internal watches start to increment the sub-second, again.

When the central processing unit starts the job sequence shown in FIG. 15, the central processing unit of each automatic player piano sets the internal watch by a standard watch, which broadcasts the standard time through radio waves, as by step S68.

Subsequently, the central processing unit of one of the automatic player pianos reads present time ttA on the internal watch, and transmits an event code and a time code expressing the present time ttA to the other automatic player piano through the internet as by step S69. The event code expresses the measurement of time lag.

The event code and time code arrive at the other automatic player piano, and the central processing unit reads the arrival time ttB on the internal watch. The central processing unit determines the communication time lag DAB through the subtraction between the time ttA and the arrival time ttB as by step S70.

The central processing unit of other automatic player piano reads the present time ttB' on the internal watch, and transmits the event code and a time code expressing the present time ttB' to the automatic player piano through the internet as by step S71.

The event code and time code arrive at the automatic player piano, and the central processing unit reads the arrival time ttA' on the internal watch. The central processing unit determines the communication time lag DBA through the subtraction between the time ttB' and the arrival time ttA'.

The automatic player pianos transmit the time codes expressing the communication time lag DAB and DBA so as to exchange the communication time lags DAB and DBA as by step S73. Thus, the communication time lag is determined.

If the central processing unit of other automatic player piano transmits the time code expressing the communication time lag DAB together with the event code and time code ttB' at step S71, the transmission step is reduced. Moreover, the job sequence may be repeated so as to determine the communication time lag as an average of plural communication time lags DAB/DBA.

Figure 16:
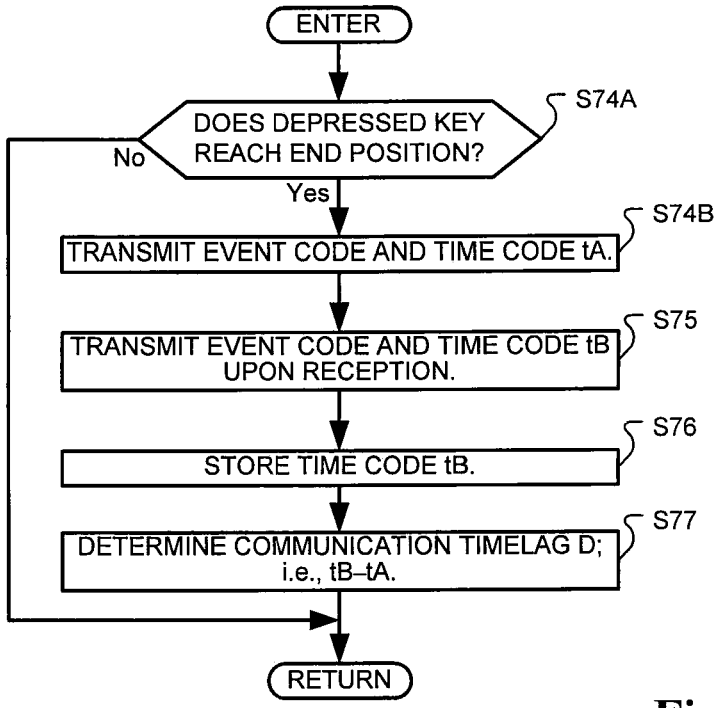
FIG. 16 is a flowchart showing a job sequence for periodically measuring a communication time lag.

Although the preparation work at step S29 is carried out once the music session for the communication time lag D, the determination on the communication time lag D may be repeated during the music session. FIG. 16 shows a job sequence for periodically measuring the communication time lag D. While the central processing unit is reiterating the loop consisting of steps S30 to S34B, the central processing unit periodically enters the job sequence shown in FIG. 16 through timer interruptions.

When the central processing unit enters the job sequence, the central processing unit checks the random access memory to see whether or not any one of the keys reach the end position as by step S74A. When the answer at step S74A is given negative "no", the central processing unit immediately returns to the loop S30 to S34.

On the other hand, if the answer is given affirmative, the central processing unit transmits an event code and a time code expressing present time tA to the other automatic player piano through the communication network as by step S74B. Upon reception of the event code and time code tA, the other automatic player piano transmits the event code and a time code expressing the arrival time tB to the automatic player piano as by step S75.

When the event code and time code tB arrive at the automatic player piano, the arrival time code tB is memorized in the random access memory as by step S76. The central processing unit determines the communication time lag through the subtraction between the present time tA and the arrival time tB as by step S77.

Figure 17:
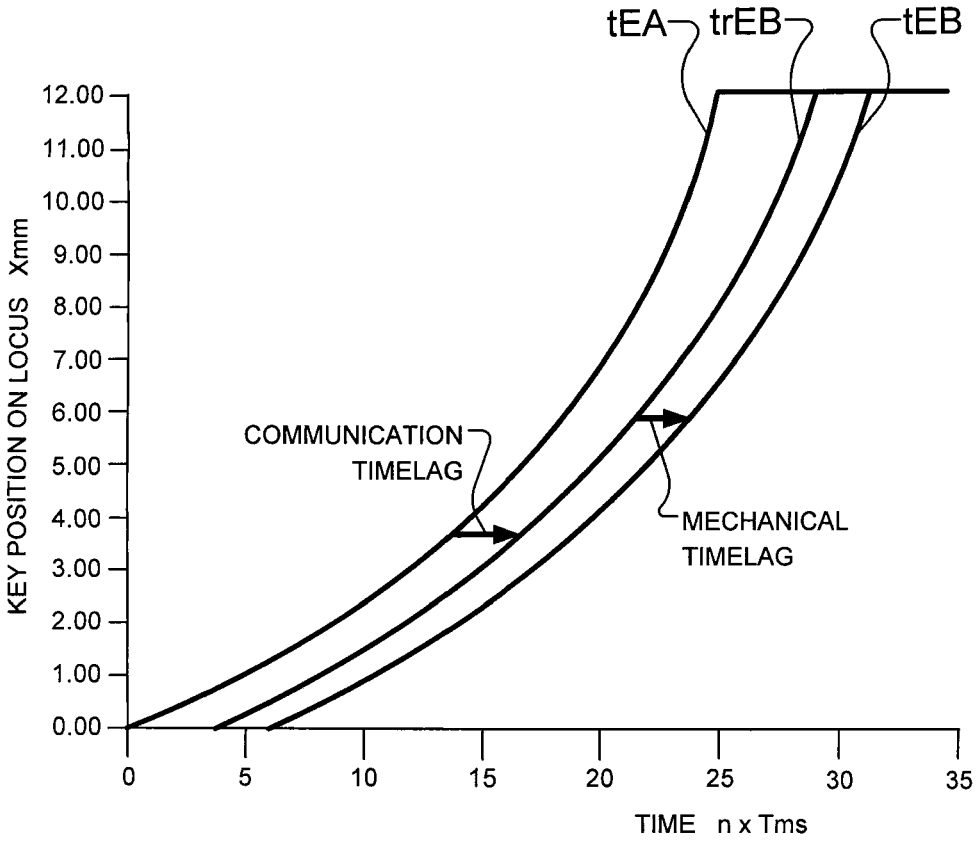
FIG. 17 is a diagram showing an actual key trajectory in the master musical instrument, a presumed key trajectory trEB and an actual key trajectory in the slave musical instrument in terms of time.

FIG. 17 shows the key position on the actual key trajectory tEA in the master musical instrument, key position on the presumed key trajectory trEB and key position on the actual key trajectory in the slave musical instrument. The presumed key trajectory trEB is delayed from the actual key trajectory tEA due to the communication time lag, and the actual key trajectory tEB is delayed from the presumed key trajectory trEB due to the solenoid-operated key actuator, i.e., mechanical delay.

Figure 18:
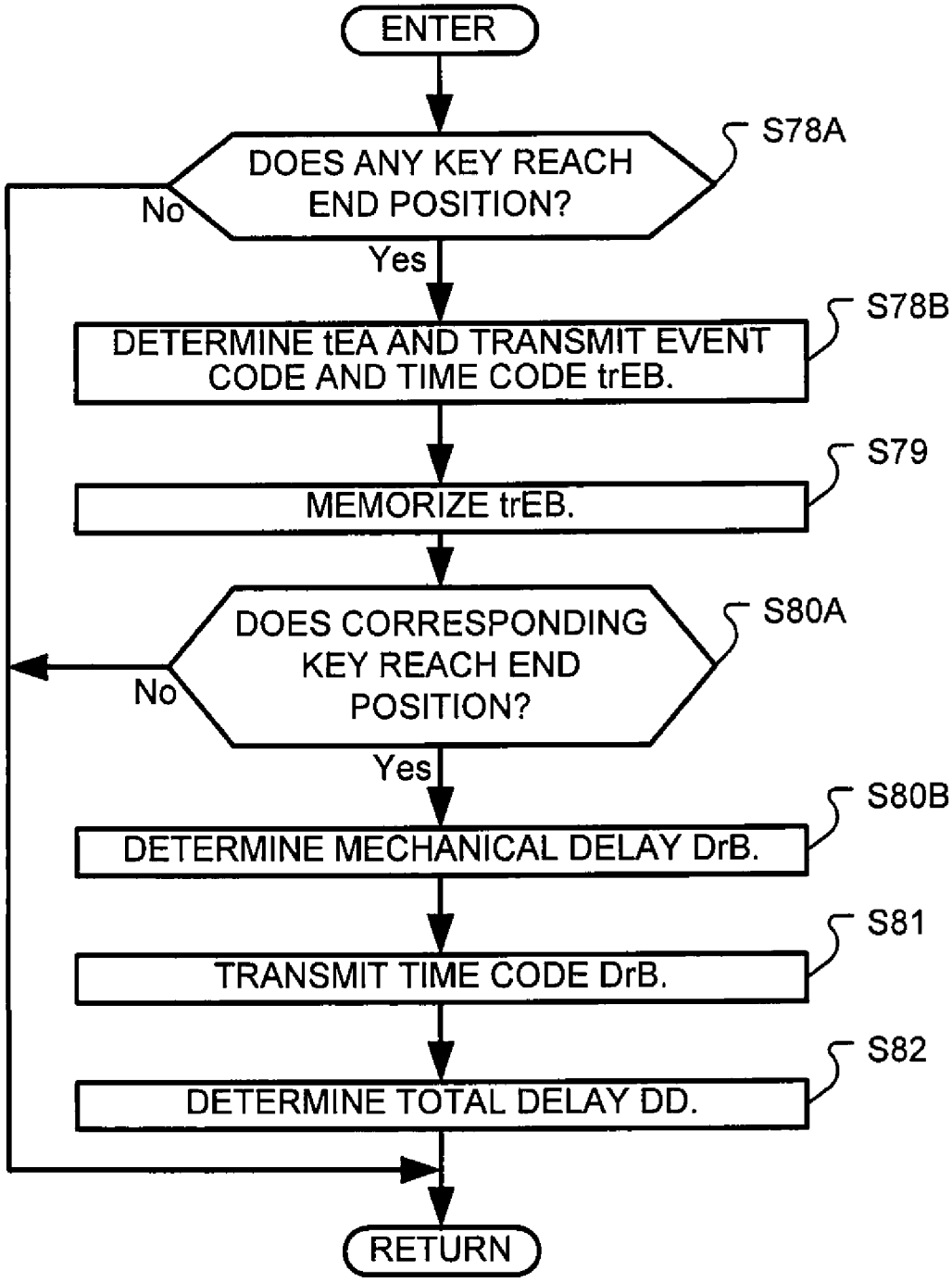
FIG. 18 is a flowchart showing a job sequence for determining a mechanical time lag.

Both of the communication time lag and mechanical time lag are taken into account for the control on the corresponding keys as shown in FIG. 18. Since the communication time lag DAB/DBA is determined as shown in FIG. 16, the jobs for determining the communication time lag DAB/DBA are deleted from the job sequence shown in FIG. 18 for the sake of simplicity.

The central processing units periodically enter the job sequence through timer interruptions. When the central processing unit of an automatic player piano enters the job sequence, the central processing unit checks the random access memory to see whether or not any one of the keys reaches the end position as by step S78A.

If the answer at step S78A is given negative "no", the central processing unit of automatic player piano immediately returns to the loop S30 to S34B. On the other hand, when the central processing unit finds a key arriving at the end position, the answer at step S78A is given affirmative "yes". With the positive answer "yes", the central processing unit stores the time on the plots tEA in the random access memory, and transmits an event code and time code expressing the time on the plots trEB to the other automatic player piano as by step S78B.

When the event code and time code arrives at the other automatic player piano, the central processing unit of other automatic player piano stores the time on the plots trEB in the random access memory as by step S79.

The central processing unit of other automatic player piano checks the random access memory to see whether or not the corresponding key arrives at the end position as by step S80A. If the answer at step S80A is given negative "no", the central processing unit returns to the loop. On the other hand, when the corresponding key arrives at the end position, the answer at step S80A is given affirmative "yes", and the central processing unit determines the mechanical time lag DrB through the subtraction as by step S80B. The central processing unit of other automatic player piano transmits a time code expressing the mechanical time lag DrB to the automatic player piano as by step S81.

When the time code arrives at the automatic player piano, the central processing unit of automatic player piano determines the total delay DD through the addition between the communication time lag and the mechanical time lag as by step S82.

The job sequence shown in FIG. 18 forms a part of the music session shown in FIG. 6. Since not only the communication time lag but also mechanical time lag are taken into account for the control on the keys of the slave musical instrument, the keys of slave musical instrument are well synchronized with the keys of master musical instrument, and the music tune is concurrently performed on both of the master musical instrument and slave musical instrument.

Third Embodiment

Figure 19:
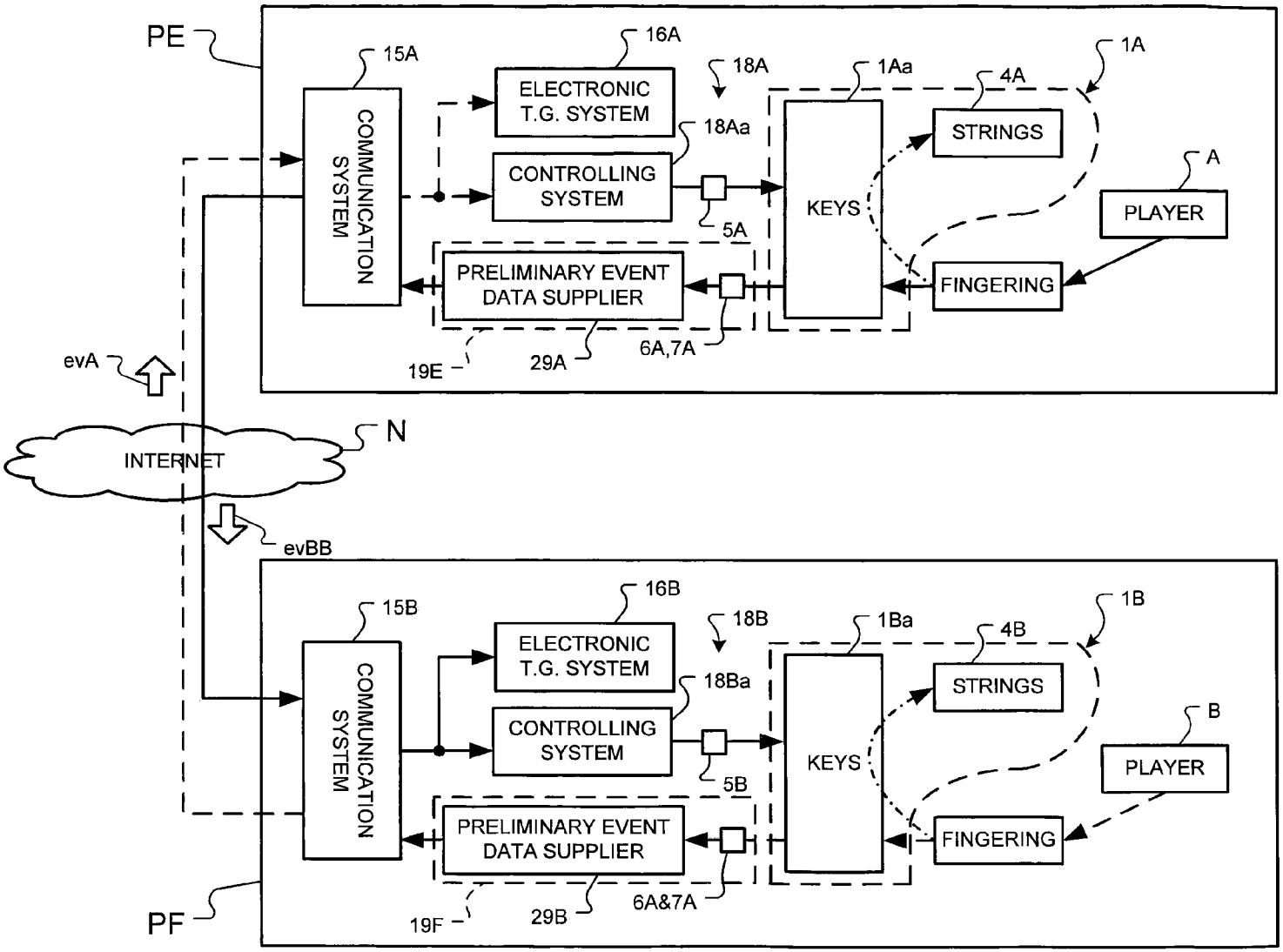
FIG. 19 is a block diagram showing the system configuration of yet another music performance system of the present invention.

Turning to FIG. 19 of the drawings, yet another performance system embodying the present invention comprises automatic player pianos PE and PF and the internet N.

The automatic player pianos PE and PF are similar to the automatic player pianos PA and PB except for music data producing systems 19E and 19F. For this reason, the other components of automatic player pianos PE and PF are labeled with references designating corresponding components of automatic player pianos PA and PB without detailed description for the sake of simplicity. Furthermore, component parts of acoustic pianos of automatic player pianos and the system components of controlling systems 18Aa and 18Ba are labeled with references designating the corresponding component parts of acoustic piano shown in FIG. 2 and the corresponding system components of controlling system shown in FIG. 3.

In the music data producing systems 19E and 19F include preliminary event data suppliers 29A and 29B, respectively, and the preliminary event data suppliers 19E and 19F feature the automatic player pianos PE and PF. Description is hereinafter focused on the preliminary event data suppliers PE and PF.

The automatic player pianos PE and PF are assumed to be assigned to users A and B. The user A is assumed to perform a piece of music on the keys 1Aa of acoustic piano 1A of the automatic player piano PE. When the music data processing system 19E finds a moved key 1Aa, the music data producing system 19E produces a presumed event data code evBB on the basis of the piece of key position data. The presumed event data code evBB is produced through the function of preliminary event data supplier 29A. The presumed event data code evBB is loaded in a packet, and the packet is transmitted from the communication system 15A to the communication system 15B through the internet N.

When the packet arrives at the communication system 15B, the presumed event data code evBB is unloaded from the packet. The presumed event data code evBB is supplied to the electronic tone generating system 16B, and the electronic tone is generated through the sound system of electronic tone generating system 16B. The presumed event data code evBB is further supplied to the controlling system 18Ba, and the controlling system 18Ba determines the reference forward silent trajectory on the basis of the presumed event data code. The controlling system 18Ba forces the corresponding key 1Ba to travel on the reference forward silent trajectory and reference backward silent trajectory. Since the communication time lag is taken into the account in the preparation work for the presumed event data code evBB, the corresponding key 1Ba is moved in synchronism with the key 1Aa. Thus, the music tune is concurrently performed on both of the automatic player pianos PE and PF.

Figure 20:
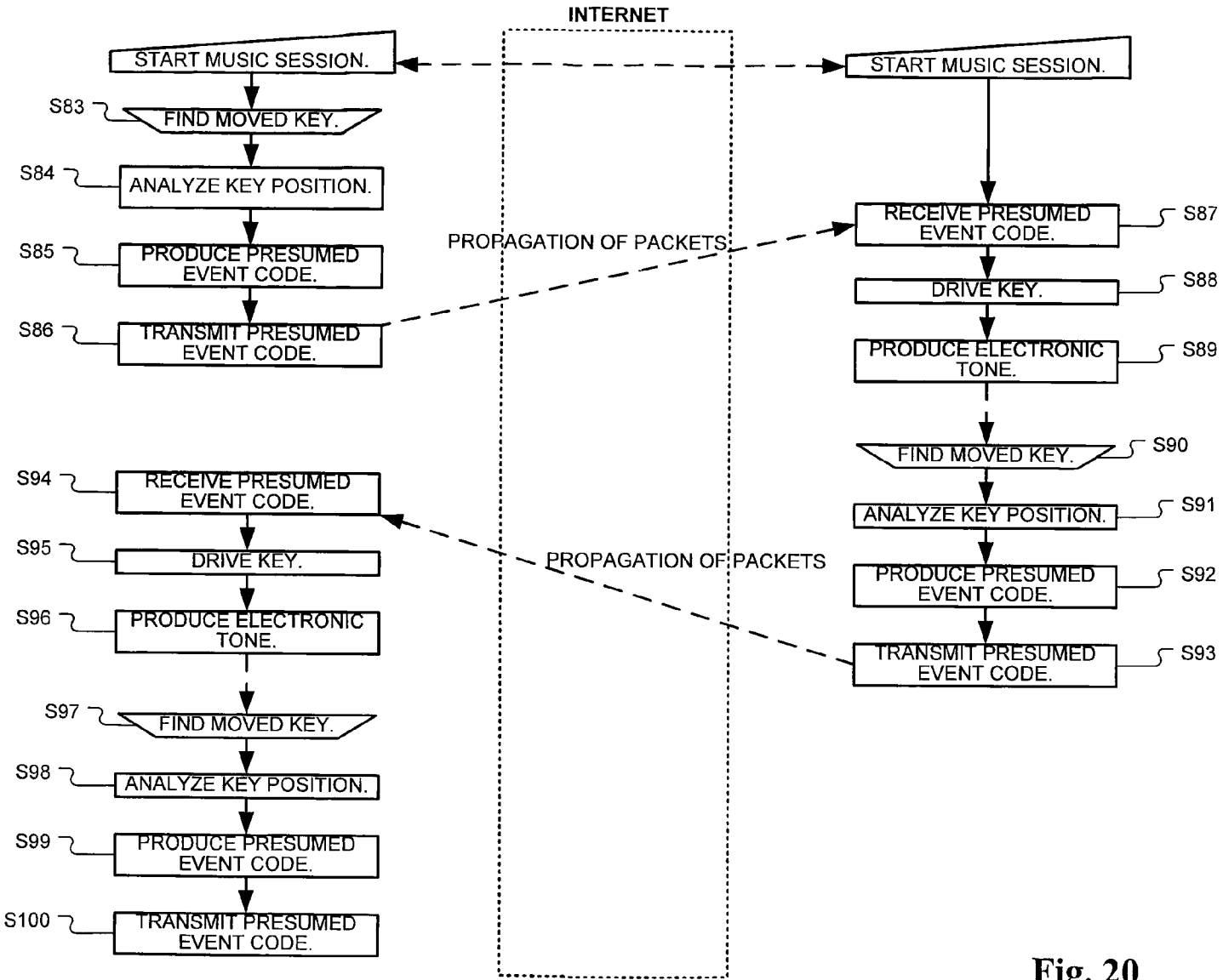
FIG. 20 is a flowchart showing a job sequence in a music session.

FIG. 20 shows a job sequence for a depressed key 1Aa and the corresponding key 1Ba. When the depressed key 1Aa is released, a presumed event data code evBB is produced for the released key 1Aa, and the corresponding key 1Ba is forced to travel on the reference backward silent trajectory. The job sequence for the released key is similar to the job sequence shown in FIG. 20. Description is hereinafter made on the job sequence only for the depressed key.

When the user A depresses the key 1Aa, the associated key sensor 6A finds the depressed key 1Aa as by step S83, and the piece of key position data is supplied from the associated key sensor 6A to the signal interface. The central processing unit 20 of controlling system 18Aa periodically fetches the piece of key position data from the signal interface so as to accumulate values of the piece of key position data in the random access memory 22.

The central processing unit 20 analyzes the piece of key position data as by step S84, and produces the presumed event data code evBB expressing a presumed key event as by step S85. The presumed key event is indicative of the note-on key event or note-off key event at a time later than the present time by the communication time lag. Thus, the note-on key event and note-off key event are preliminarily informed prior to an actual note-on event and an actual note-off event. Description is hereinlater made on how the event data code is produced.

The presumed key event code evBB is loaded in a packet, and the packet is transmitted to the automatic player piano PF through the internet N as by step S86. The packet is received by the automatic player piano PF as by step S87.

The piece of presumed key event data is unloaded from the packet, and is transferred to the automatic playing system 18B. The automatic playing system 18B forces the corresponding key 1Ba to travel on the reference forward silent trajectory as by step S88. Although the communication time lag is unavoidably introduced between the packet transmission and the packet reception, the presumed key event data was produced in advance of the actual note-on key event so that the corresponding key 1Ba is moved in synchronism with the depressed key 1Aa.

The piece of presumed key event data is further transferred to the electronic tone generating system 16B, and an electronic tone is produced through the electronic tone generating system 16B as by step S89.

When the user B depresses a key 1Ba, the above-described jobs are repeated as by steps S90, S91, S92, S93, S94, S95 and S96. The presumed key event data code for the automatic player piano PE is labeled with "evA" in FIG. 19. The corresponding key 1Aa is forced to travel on the reference forward silent trajectory, and the electronic tone is generated.

When the user A depresses another key 1Aa, the preliminary event data supplier 29A executes the jobs, which are same as those at steps S83 to 86, as by step S97, S98, S99 and S100.

Though not shown in FIG. 20, when the user A or B releases the depressed key 1Aa or 1Ba, the preliminary event data supplier 29A or 29B produces the presumed event data code evBB or evA for the note-off event, and transmits the piece of presumed event data to the other automatic player piano PH or PG. The controlling system 18Ba or 18Aa determines the reference backward key trajectory on the basis of the piece of presumed event data, and forces the corresponding key 1Ba or 1Aa to travel on the reference backward silent trajectory. As a result, the damper 8 is brought into contact with the vibrating string 4, and makes the acoustic piano tone decayed.

Though not shown in the drawings, the central processing unit 20A executes the job sequences similar to the job sequences shown in FIGS. 7 and 8 in the music session, and the communication time lag is determined. However, the data processing for key is different from the corresponding step S31. Assuming now that the user A depresses one of the keys 1Aa in the music session, the central processing unit 20A produces the presumed key event data code evBB through the job sequence shown in FIG. 21. The number of reference cycle time T is expressed as "n", and the reference cycle time is assumed to be counted from the departure of rest position. The key velocity V is expressed as V[n], and the final hammer velocity vv is assumed to be proportional to the key velocity V. In other words, the final hammer velocity vv is expressed as vv=m×V[n] where m is a coefficient.

When the central processing unit 20A enters the job sequence, the central processing unit 20A fetches the piece of key position data expressing the current key position yx[n] of the key 1Aa, and accumulates the piece of key position data yx[n] in the random access memory 22A after the analog-to-digital conversion and normalization as by step S101.

Subsequently, the central processing unit 20A determines the present key velocity yv[n] as by step S102. The present key velocity yv[n] is given by equation 2, i.e., yv[n]=(yx[n]−yx[n−1])/T. The central processing unit 20A averages the values of present key velocity as by step S103. The average V[n] is given as V[n]=(yv1+, . . . , +yv[n])/n.

Subsequently, the central processing unit 20A presumes the key position rx[n+D] at a time later than the present time [n] by the communication time lag D as by step S104. The presumed key position rx[n+D] is given as equation 7.

$$rx[n+D]=yx[n]+V[n]\times(D\times T) \quad \text{Equation 7}$$

where T is a time period equal to the reference cycle time T. Thus, the distance from the present time and the time for the presumed key position rx[n+D] is expressed by using the absolute time (D×T).

Figure 22:
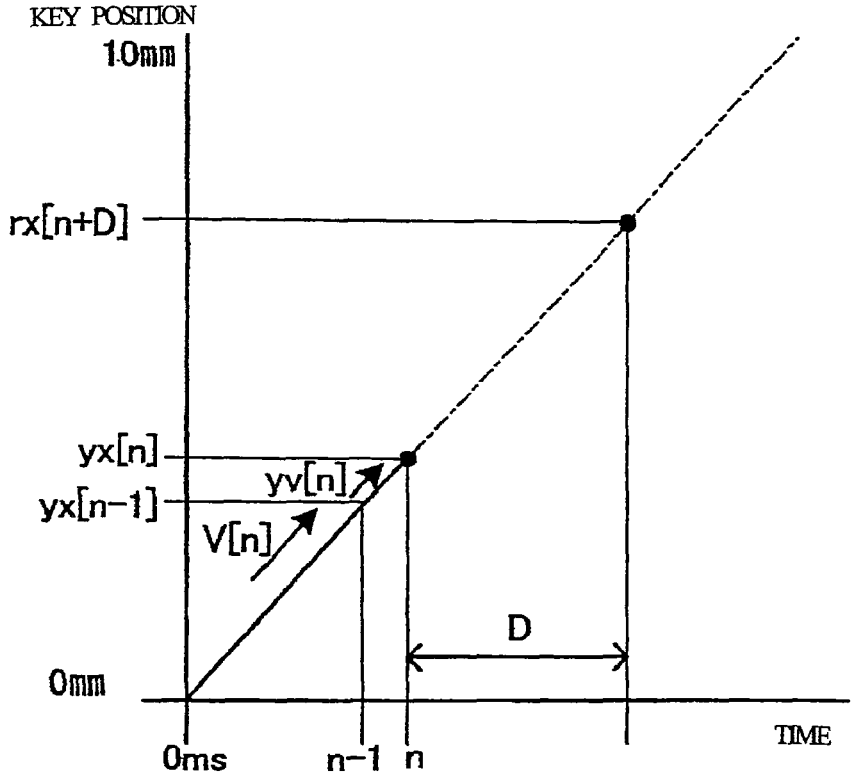
FIG. 22 is a graph showing a presumed key position on a key trajectory.

The data processing at steps S101 to S104 is illustrated in FIG. 22. The present time is expressed as [n], and yv[n] is indicative of the present key velocity between time [n−1] and time [n]. The averaged key velocity V[n] is appropriate from time 0 to time [n]. Since the key 1Aa is expected to move at the averaged key velocity V[n], the key position rx[n+D] is determinable on the basis of plots expressing the averaged key velocity V[n]. Thus, the central processing unit 20A presumes the key position at the time [n+D] later than the present time t[n] by the communication time lag D as by step S104.

Subsequently, the central processing unit 20A compares the presumed key position rx[n+D] with the end position to see whether or not the key 1Aa is deemed to reach the end position at the time t[n+D] as by step S105. In this instance, the end position is spaced from the reset position by 10 millimeters.

While the presumed key position rx[n+D] is being found on the way to the rest position, the answer at step S105 is given negative "no", and the central processing unit 20A immediately returns to the loop S30 to S34B. However, when the presumed key position rx[n+D] is found at the end position, the answer at step S105 is changed to affirmative "yes". Then, the central processing unit 20Aa produces the presumed key event data code evBB. The presumed key event data code evBB/evA for the tone generation is same in format as the music data code expressing the note-on key event. The note-on message, note number, which is identical with the key number, and velocity, which is equivalent to the final hammer velocity vv, are stored in the presumed key event data code evBB. Finally, the central processing unit 20A transmits the presumed key event data evBB to the automatic player piano PF as by step S106.

The automatic playing system 18B forces the corresponding key 1Ba to travel on the reference forward silent key trajectory, and the electronic tone generating system 16B produces the electronic tone instead of the acoustic piano tone. The behavior of automatic playing system 18B is similar to that illustrated in FIG. 9B. Although the communication time lag D is unavoidably introduced between the transmission of presumed key event data code evBB/evA and the reception, the presumed event data code evBB/evA is transmitted to the other automatic player piano in advance of the arrival of the depressed key at the end position so that the communication time lag is canceled. For this reason, the corresponding keys are moved in synchronism with the depressed keys.

When the depressed key 1Aa is released, the preliminary event data supplier 29A produces the presumed key event data code evBB expressing the note-off key event as similar to the key event data code expressing the note-on key event, and transmits the presumed key event data code evBB to the other automatic player piano PF.

Figure 21:
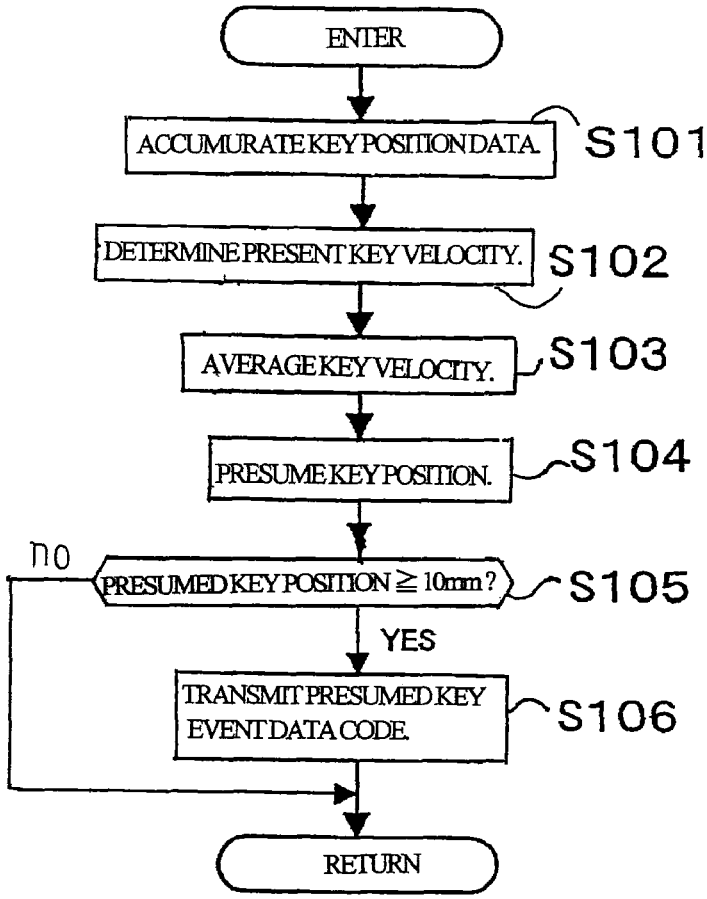
FIG. 21 is a flowchart showing a job sequence for producing a presumed key event data code.

While the user B is fingering a music tune on the automatic player piano PF, the preliminary event data supplier 29B produces the presumed key event data codes evA through the data processing shown in FIG. 21, and the communication system 15B transmits the presumed key event data codes evA to the communication system 15A of automatic player piano PE. The corresponding key 1Aa is moved, and the electronic tone is generated as described in conjunction with the automatic player piano PF.

As will be understood from the foregoing description, the automatic player piano PE or PF produce the presumed key event data codes evBB/evA in advance of the occurrence of key events, and transmit the presumed key event data codes evBB/evA from one of the automatic player pianos PE and PR to the other of the automatic player pianos PF or PE. The presumed key event data codes evBB/evA make the key events occur in both of the automatic player pianos PE and PF. Thus, the keys and corresponding keys are synchronously driven in both of the automatic player pianos PE and PF.

In the third embodiment, the key trajectory is assumed to be expressed by the linear line as shown in FIG. 22. However, the key trajectory may be expressed as a non-linear line such as the curve of second order. The communication time lag D may be determined through the job sequence shown in FIG. 15 or FIG. 16.

The preliminary event data suppliers 29A and 29B may produce presumed event data codes expressing presumed key events at a time later than the present time by a total delay time, i.e., the total of communication time lag and mechanical time lag. The total delay time is determined as follows.

Figure 23:
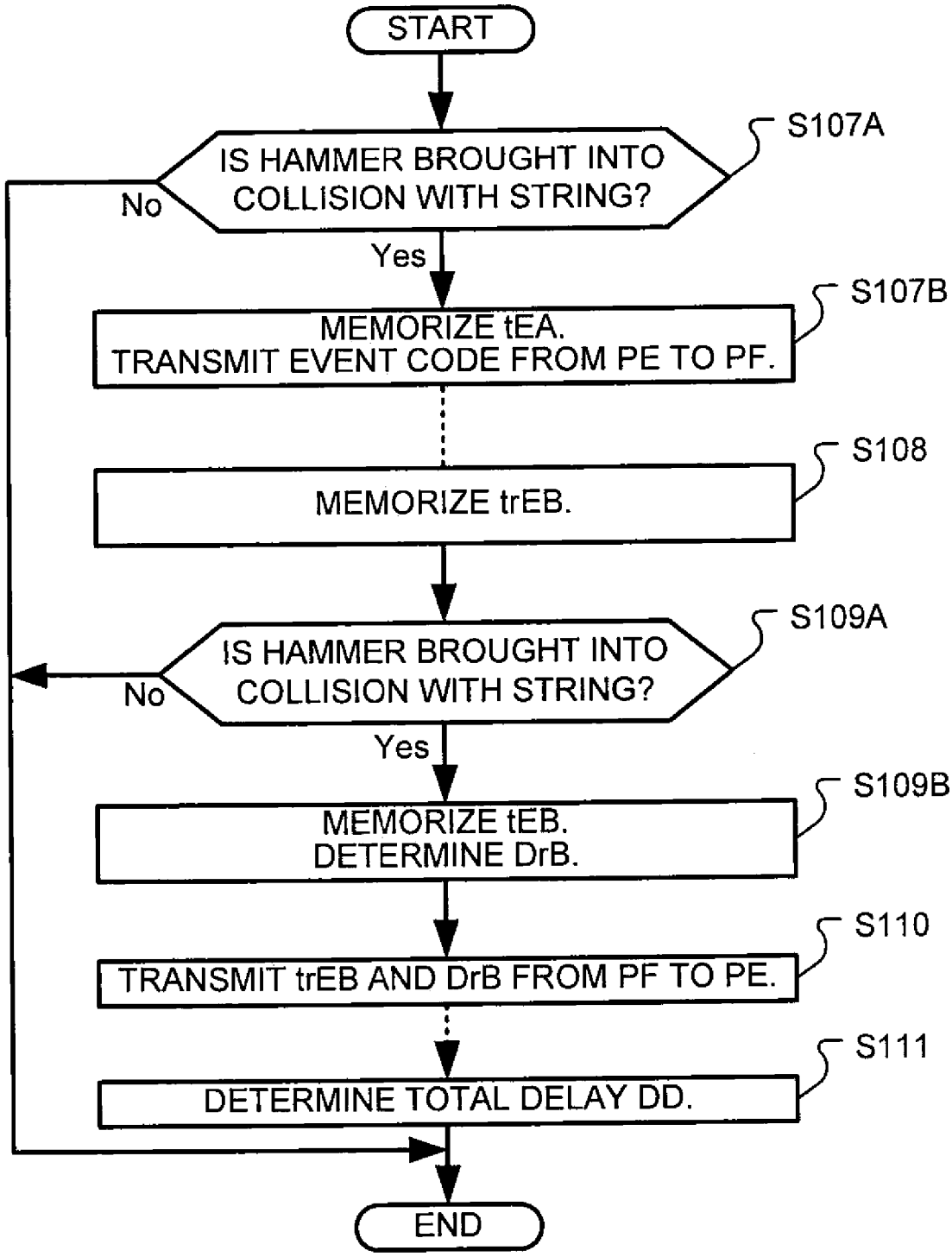
FIG. 23 is a flowchart showing a job sequence for determining a total delay time.

FIG. 23 shows a job sequence for measuring the total time lag, i.e., the total of the communication time lag and mechanical time lag. The job sequence shown in FIG. 23 is prepared on the basis of the job sequence shown in FIG. 18. The presumed event data codes evBB are assumed to be transmitted from the automatic player piano PE to the other automatic player piano PF.

The central processing unit 20 of automatic player piano PE periodically checks the signal interface assigned to the hammer sensors 7A to see whether or not any one of the hammers 3 is brought into collision with the associated string 4 as by step S107A. While the answer is being given negative "no", the central processing unit 20 immediately returns to the loop S30 to S34B.

The user is assumed to depress one of the keys 1Aa. The central processing unit 20 of automatic player piano PE carries out the data processing on the piece of key position data so as to produce the presumed key event data as described hereinbefore. The depressed key 1Aa gives rise to the actuation of associated action unit 2, which in turn gives rise to the rotation of associated hammer 3. While the hammer 3 is rotating toward the associated string 4, the hammer sensor 7A varies the hammer position signal S2, and the values of hammer position signal S2 are periodically fetched, and are accumulated in the random access memory 22. When the hammer 3 is brought into collision with the string 4, the central processing unit 20 acknowledges the collision with the string 4, and the answer at step S107A is changed to affirmative "yes". Then, the central processing unit 20 determines the time tEA at which the hammer 3 is brought into collision with the string 4.

The central processing unit 20 memorizes the time tEA in the random access memory 22, and transmits a packet where an event code and time data code expressing the time tEA to the other automatic player piano PF through the internet N as by step S107B.

When the packet arrives at the communication system 15B, the central processing unit 20 determines the time at which the packet arrives at the communication system 15B, and the piece of time data trEB is memorized in the random access memory 22 as by step S108.

The central processing unit 20 of automatic player piano PF periodically checks the random access memory 20 to see whether or not the hammer 3 is deemed to be brought into collision with the associated string 4 as by step S109A. The hammer sensor 7B monitors the hammer 3 associated with the corresponding key 1Ba, and the piece of hammer position data is accumulated in the random access memory 22. Since the associated key 1Ba travels on the reference forward silent trajectory, the hammer 3 does not reach the associated string 4. When the hammer 3 starts the rotation through the escape, the central processing unit 20 presumes the time tEB at which the hammer 3 is brought into collision with the string 4 on the assumption that the action unit 2 transmits standard force to the hammer 3 through the escape. The central processing unit 20 subtracts the arrival time trEB from the time tEB so as to determine the mechanical time lag DrB as by step S109B.

The central processing unit 20 produces a packet where the pieces of time data expressing the arrival time trEB and mechanical time lag DrB are loaded, and transmits the packet to the automatic player piano PE through the internet N as by step S110.

When the packet arrives at the communication system 15A, the pieces of time data are unloaded from the packet. The central processing unit 20 of automatic player piano PE subtracts the time tEA from the arrival time trEB so as to determine the communication time lag. The central processing unit adds the communication time lag to the mechanical time lag DrB, and determines the total delay time DD as by step S111.

Fourth Embodiment

Figure 24:
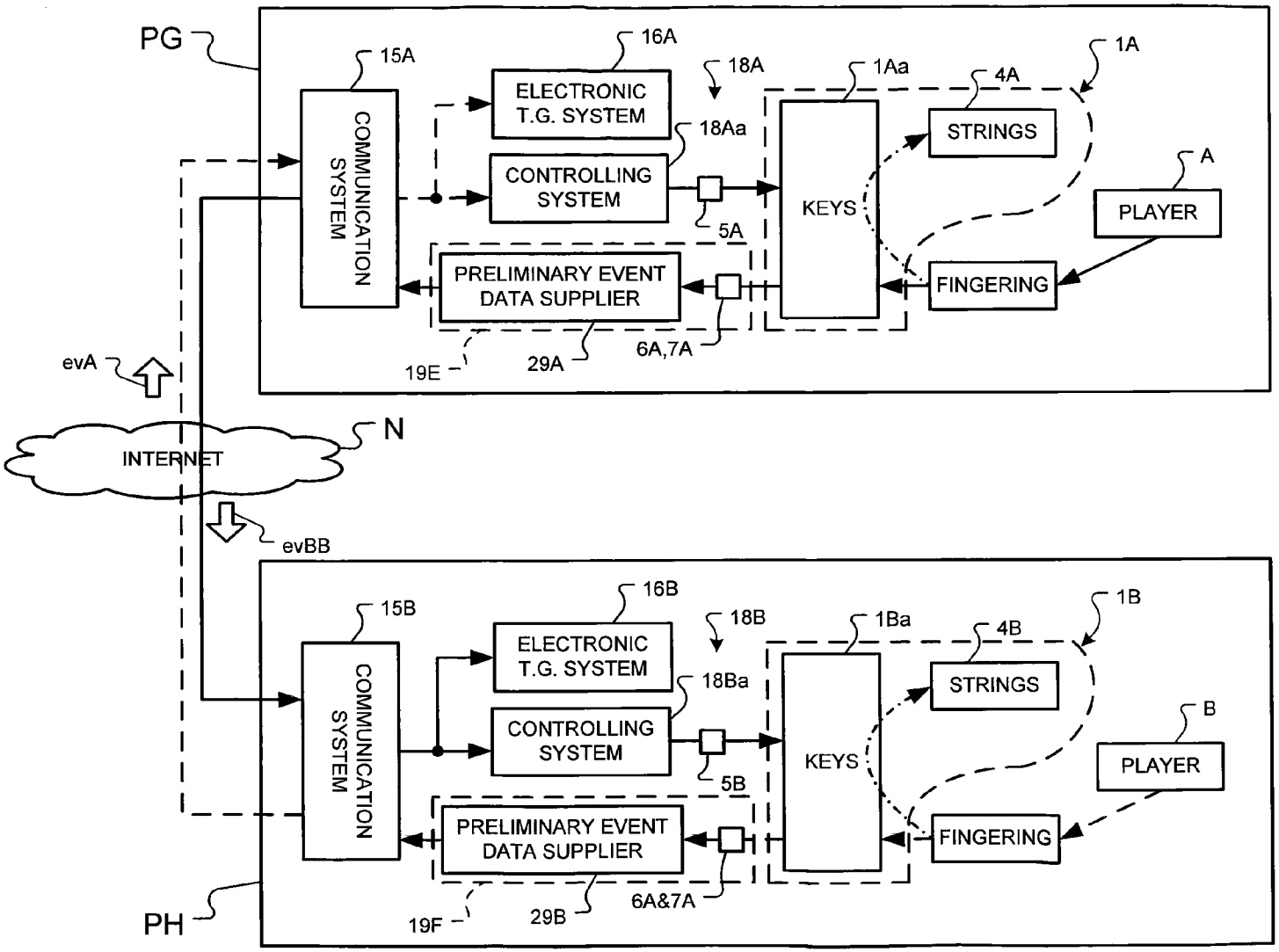
FIG. 24 is a block diagram showing the system configuration of still another music performance system of the present invention.

Turning to FIG. 24 of the drawings, still another music performance system embodying the present invention largely comprises automatic player pianos PG and PH and the internet N. The automatic player piano PG and PH are similar to the automatic player piano PE and PF except for a subroutine program for music session. For this reason, components of the automatic player pianos PG and PH are labeled with references designating the corresponding components of automatic player pianos PE and PF without detailed description. Furthermore, component parts of acoustic pianos of automatic player pianos and the system components of controlling systems 18Aa and 18Ba are labeled with references designating the corresponding component parts of acoustic piano shown in FIG. 2 and the corresponding system components of controlling system shown in FIG. 3.

The subroutine program for music session is different from that of the third embodiment except for a job sequence for driving corresponding keys 1Aa or 1Ba. In the music performance system implementing the fourth embodiment, the central processing unit 20 of master musical instrument produces the presumed key event data codes evBB/evA for the depressed keys and released keys, and the central processing unit 20 of slave musical instrument determines the reference forward key trajectory and reference backward key trajectory instead of the reference forward silent trajectory and reference backward silent trajectory on the basis of the presumed key event data codes evBB/evA. The controlling system 18Aa or 18Ba of slave musical instrument forces the keys 1Aa or 1Ba to travel on the reference forward key trajectories and reference backward key trajectories so that the acoustic piano tones are generated through the vibrations of strings 4 in the slave musical instrument.

Figure 25:
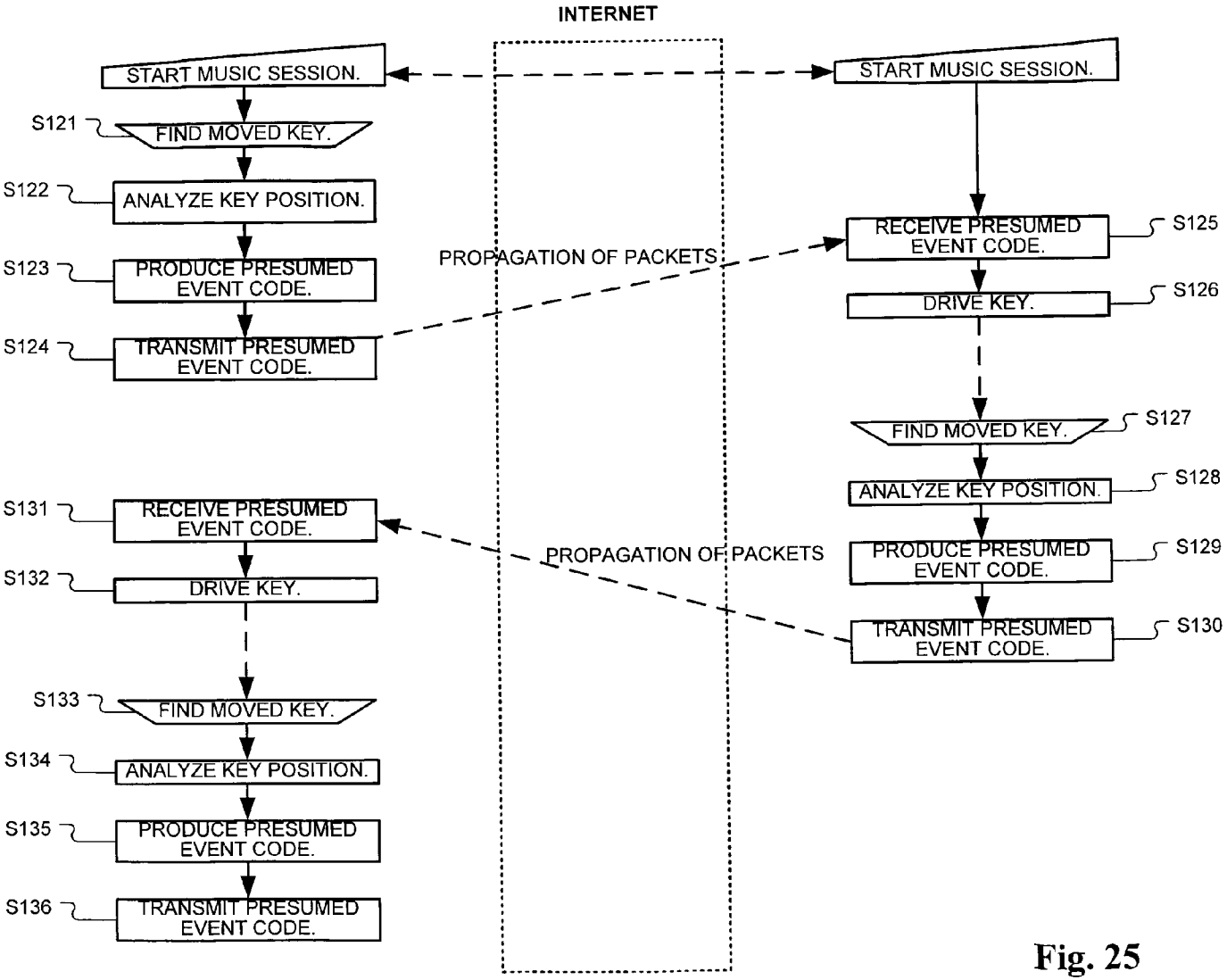
FIG. 25 is a flowchart showing a job sequence in a music session

FIG. 25 shows a job sequence for the music session. When the user A depresses the key 1Aa, the associated key sensor 6A finds the depressed key 1Aa as by step S121, and the piece of key position data is supplied from the associated key sensor 6A to the signal interface. The central processing unit 20 periodically fetches the piece of key position data from the signal interface so as to accumulate values of the piece of key position data in the random access memory 22.

The central processing unit 20 analyzes the piece of key position data as by step S122, and produces a presumed event data code evBB expressing a presumed key event as by step S123. The presumed key event is indicative of the note-on key event or note-off key event at a time later than the present time by the communication time lag. Thus, the note-on key event and note-off key event are preliminarily informed prior to an actual note-on event and an actual note-off event. The presumed event data codes evBB are produced through the job sequence shown in FIG. 21.

The presumed key event code evBB is loaded in a packet, and the packet is transmitted from the automatic player piano PG to the automatic player piano PH through the internet N as by step S124. The packet is received by the automatic player piano PH as by step S125.

The piece of presumed key event data is unloaded from the packet, and is transferred to the automatic playing system 18B. The automatic playing system 18B determines the reference forward key trajectory on the basis of the piece of presumed event data, and forces the corresponding key 1Ba to travel on the reference forward key trajectory as by step S126. The corresponding key 1Ba actuates the associated action unit 2, which in turn gives rise to rotation of associated hammer 3. The hammer 3 is brought into collision with the string 4 at the end of rotation, and gives rise to vibrations of the string 4. As a result, the acoustic piano tone is generated through the vibrations of string 4.

Although the communication time lag is unavoidably introduced between the packet transmission and the packet reception, the presumed key event data was produced in advance of the actual note-on key event so that the corresponding key 1Ba is moved in synchronism with the depressed key 1Aa.

When the user B depresses a key 1Ba, the above-described jobs are repeated as by steps S127, S128, S129, S130, S131 and S132. The corresponding key 1Aa is forced to travel on the reference forward key trajectory, and the electronic tone is generated.

When the user A depresses another key 1Aa, the preliminary event data supplier 29A executes the jobs, which are same as those at steps S121 to 124, as by step S133, S134, S135 and S136.

Though not shown in FIG. 25, when the user A or B releases the depressed key 1Aa or 1Ba, the preliminary event data supplier 29A or 29B produces the presumed event data code evBB/evA for the note-off event, and transmits the piece of presumed event data to the other automatic player piano PH or PG. The controlling system 18Ba or 18Aa determines the reference backward key trajectory on the basis of the piece of presumed event data, and forces the corresponding key 1Ba or 1Aa to travel on the reference backward silent trajectory. As a result, the damper 8 is brought into contact with the vibrating string 4, and makes the acoustic piano tone decayed.

As will be understood from the foregoing description, the communication time lag is canceled with the presumed key event data indicative of the key event at the time later than the present time by the communication time lag. For this reason, the keys of slave musical instrument are moved in synchronism with the keys of master musical instrument.

The preliminary event data suppliers 29A and 29B may produce presumed event data codes evBB/evA expressing presumed key events at a time later than the present time by a total delay time, i.e., the total of communication time lag and mechanical time lag. The total delay time may be determined through the job sequence shown in FIG. 23.

Modifications

Although particular embodiments of the present invention have been shown and described, it will be apparent to those skilled in the art that various changes and modifications may be made without departing from the spirit and scope of the present invention.

The MIDI protocols do not set any limit to the technical scope of the present invention. Other sorts of music data protocols are known, and are available for the music data codes used in the music performance system.

The pieces of presumed key motion data and pieces of presumed event data do not set any limit to the technical scope of the present invention. The sampled values of key position data may be transmitted from the master musical instrument to the slave musical instrument. In this instance, the key sensors have a detectable range as wide as or wider than the keystroke, and the controlling system of slave musical instrument presumes the key position or key event at the arrival time.

One of the automatic player pianos may serve as the master musical instrument. In this instance, the pieces of presumed key motion data or pieces of presumed event data are unidirectionally transmitted from the master musical instrument to the slave musical instrument or slave musical instruments.

An automatic player piano of the music performance system may have either key sensors 6 or hammer sensors 7. In other words, either key sensors 6 or hammer sensors 7 are dispensable.

Key velocity sensors or plunger velocity sensors may be installed in the automatic player pianos PA and PB. In this instance, the motion controller 12 directly determines the current key velocity from key velocity signals or plunger velocity signals.

The pulse width modulation does not set any limit to the technical scope of the present invention. Any sort of signal modulation is available for the servo control in so far as the strength of magnetic field is controllable.

The internet N does not set any limit to the technical scope of the present invention. The automatic player musical instruments PA and PB may be connected through a LAN (Local Area Network) or MAN (Metropolitan Area Network). The network may be based on the Ethernet (trademark).

The packet transmission does not set any limit to the technical scope of the present invention. The pieces of presumed key motion data and pieces of presumed event data may be transmitted from the master musical instrument to the slave musical instrument through a base band transmission through a cable. Otherwise, the pieces of presumed key motion data and pieces of presumed event data may be transmitted from the master musical instrument to the slave musical instrument through a radio channel.

The reference key velocity for the reference forward silent trajectory may be produced from the pieces of key trajectory data modified with pieces of control data stored in the read only memory 21. In this instance, the reference forward key velocity is firstly determined on the basis of the pieces of individualized performance data, which are stored in the music data codes received from another automatic player piano PA or PB, and the pieces of key trajectory data, which express the reference forward key trajectory, are modified with the pieces of control data.

The key control technique, which is disclosed in Japan Patent Application laid-open No. 2006-235216, is available for the key driving at step S5. As described hereinbefore, the action units 2 give rise to the rotation of hammers 3 through the escape. It is possible to stop the depressed keys 1*a* immediately before the escape through the key control technique disclosed in the Japan Patent Application laid-open. In other words, the reference forward silent trajectory is terminated at a certain key position immediately before the escape so that the hammers 3 are not driven for rotation. This results in the movements of keys 1*a* without any acoustic piano tone.

Two automatic player pianos PA and PB do not set any limit to the technical scope of the present invention. More than two automatic player pianos may be connected through a communication system so as to carry out a music session thereamong.

The automatic player pianos do not set any limit to the technical scope of the present invention. An automatic player piano and another sort of musical instrument may be incorporated in a music performance system of the present invention in so far as the sort of musical instrument has a capability to produce pieces of music data. An electronic keyboard, an electronic piano and another sort of electronic musical instrument such as, for example, an electronic wind musical instrument may serve as the sort of musical instrument.

Another sort of automatic player musical instrument may participate in the music session. An automatic player wind instrument, an automatic percussion instrument and an automatic stringed instrument are examples of the sort of automatic player musical instrument.

The present invention may appertain to another sort of manipulators of a musical instrument. The automatic player piano has piano pedals driven by solenoid-operated actuators. Pieces of presumed pedal motion data or pieces of presumed pedal event data, which are corresponding to the pieces of presumed key motion data and pieces of presumed event data, may be produced in the master musical instrument, and are transmitted to the slave musical instrument.

The steps S35 to S38 may be repeated. In this instance, the communication time lag D is determined as an average of the results.

The communication time lag D may be variable. In this instance, the preliminary key data suppliers 25A and 25B make the presumed key trajectory exactly overlapped with the actual key trajectory by optimizing a coefficient. In order to make the presumed key trajectory exactly overlapped with the actual key trajectory, the presumed key position rxB is multiplied with the coefficient, and the coefficient is periodically renewed.

Otherwise, the communication time lag D may be varied depending upon the gradient of estimated key trajectory. In this instance, when the preliminary key data suppliers 25A and 25B determine the estimated key trajectories at step S66, the preliminary key data suppliers 25A and 25B determines a coefficient on the basis of the gradient of estimated key trajectories, and multiply the coefficient to the communication time lag D so as to make the presumed key trajectory appropriately delayed.

The two sorts of fingering, i.e., the standard fingering and half-stroke fingering do not set any limit to the technical scope of the present invention. Sets of phases may be prepared for other sorts of fingering such as, for example, key movement without any tone, in which the key movement gives rise to the hammer rotation without collision with the string.

The phase boundaries PH1 to PH5, PH6 and PH7 do not set any limit to the technical scope of the present invention. The standard key trajectory may be divided into less five phases or greater than five phases. The half stroke key trajectory may be divided into more than two phases PH6 and PH7.

The mechanical time lag may be measured once the music session. In this instance, the total delay DD is introduced into all of the presumed key trajectories. Otherwise, the mechanical time lag may be measured upon arrival of each key at the end position. In this instance, the mechanical time lag is renewed during the performance on the master musical instrument.

In the job sequence shown in FIG. 18, the event code and time code trEB are transmitted to the slave musical instrument upon arrival of keys at the end position. However, the end position does not set any limit to the technical scope of the present invention. The central processing unit of master musical instrument may proceed to step S78B upon arrival of one of the phase boundaries or more than one phase boundaries.

The mechanical time lag may be multiply measured. In this instance, the mechanical time lag is given as the average of measured values of mechanical time lag.

The total delay DD may be shared between the master musical instrument and the slave musical instrument. Otherwise, the master musical instrument and slave musical instrument may independently determine the total delay DD.

In the third embodiment, the time tEA may be presumed on the basis of the reference forward silent trajectory. Otherwise, vibration sensors or microphones may be installed in the automatic player pianos PE and PF so as to convert the vibrations of strings 4 to the detecting signal.

The component parts of embodiments and jobs are correlated with claim languages as follows.

The automatic player pianos PA, PB, PC, PD, PE, PF, PG and PH selectively serve as "a mater musical instrument" and "a slave musical instrument". The keys 1Aa and 1Ba selectively serve as "plural manipulators" and "other manipulators", and the key sensors 6A/6B and hammer sensors 7A/7B form in combination "a converter". The key position signals S1 and hammer position signals S2 are corresponding to "detecting signals", and the key positions on the loci of keys 1Aa and 1Ba are "physical quantity". The pieces of music data, pieces of presumed key motion data or pieces of presumed event data are corresponding to "pieces of performance data".

The music data producer 13 and post data processor 14; the preliminary key data suppliers 25A/25B; or the preliminary event data suppliers 29A/29B serve as "an information processing system". The communication systems 15A/15B are corresponding to "a communication system" and "another communication system". The internet N provides "a communication channel" between the master musical instrument and the slave musical instrument. The solenoid-operated key actuators 5 are corresponding to "plural actuators", and the driving signals S3 are corresponding to "driving signals". The term "trajectory" and term "locus" are defined in the description.

The action units 2, hammers 3, strings 4 and dampers 8 as a whole constitute "a mechanical tone generating system". The electronic tone generating system 16A/16B serves as "an electronic tone generating system". The controlling system 18Aa/18Ba and subroutine program for music session serve as a "controlling system".

The central processing unit 20 and job at S6/S12 in the subroutine program for music session serve as "a delay canceller", and the preliminary key data supplier 25A/25B, function for producing key motion data 26A/26B and function for reproducing key movements 26C/26D on the basis of the pieces of presumed key motion data rxB, rvB/rxA/rvA also serve as the "delay canceller". The preliminary event data supplier 29A/29B, controlling system 18Aa/18Ba on the basis of presumed key event data codes evBB/evA also serve as the "delay canceller".

The arrow drawn from the communication system 15 to the electronic tone generator 16*a* (see FIG. 2) stands for "a selector for transferring said pieces of performance data to said electronic tone generating system." The preliminary data processor 10, motion controller 11 for producing the reference forward silent trajectory and reference backward silent trajectory and servo controller 12 stand for "a simulator." The central processing unit 10 and job at step S5/S11 also stands for the "simulator."

The central processing unit 20 and jobs at steps S40 to S45 stand for "a pre-estimator", and the production of key motion data 26A and 26B also stands for the "pre-estimator." The arrow drawn from the communication system 15 to the preliminary data processor 10 stands for "a selector", and the central processing unit 20 and jobs at steps S49 to S58 stand for a "controller." The reproduction of key movements 26C and 26D also stands for the "controller." The central processing unit 20 and jobs at steps S35 to S38 stand for an "experimenter", and the central processing unit 20 and jobs at steps S68 to S73; the central processing unit 20 and jobs at steps 74A to S77; or the central processing unit 20 and jobs at steps S78A to S82 also stand for the "experimenter".

The central processing unit 20 and jobs at steps S101 to S105 stand for a "pre-estimator", and the central processing unit 20 and jobs at steps S107A to S111 stand for an "experimenter."

What is claimed is:

1. A music performance system for a music performance on plural musical instruments, comprising:

a master musical instrument including plural manipulators selectively moved for specifying tones to be produced, a converter monitoring said plural manipulators and producing detecting signals representative of physical quantity expressing movements of said plural manipulators, an information processing system connected to said converter and producing pieces of performance data expressing a performance on said plural manipulators on the basis of said physical quantity, and a communication system connected between said information processing system and a communication channel for transmitting said pieces of performance data through said communication channel;

a slave musical instrument including another communication system connected to said communication channel and receiving said pieces of performance data from said communication system, other manipulators for specifying tones to be produced, plural actuators provided for said other manipulators and selectively energized with driving signals so as to give rise to movements of said other manipulators on trajectories, a mechanical tone generating system connected to said other manipulators and producing acoustic tones when said other manipulators strongly actuate said mechanical tone generating system, and a controlling system connected to said another communication system and said plural actuators and selectively supplying said driving signals produced on the basis of said pieces of performance data to said plural actuators so as selectively to move said other manipulators on said trajectories; and a delay canceller provided in association with said information processing system so as to reduce a time lag between the transmission of said pieces of performance data and the generation of said acoustic tones, wherein said delay canceller has a pre-estimator provided in association with said information processing system and presuming said physical quantity at a time later than the present time by at least part of said delay time so as to make said pieces of performance data contain pieces of motion data expressing the presumed physical quantity, and a controller provided in association with said controlling system and causing said plural actuators to force said other manipulators to have said presumed physical quantity, whereby said other manipulators strongly actuate said mechanical tone generating system for producing said acoustic tones.

2. The music performance system as set forth in claim 1, in which said delay canceller further has an experimenter determining the amount of said delay time and informing said pre-estimator of said amount of said delay.

3. The music performance as set forth in claim 1, in which the master musical instrument further includes another mechanical tone generating system connected to said plural manipulators and producing acoustic tones when said plural manipulators strongly actuate said another mechanical tone generating system so that said slave musical instrument generates said electric tones or said acoustic tones concurrently with said acoustic tones produced through said master musical instrument.

4. The music performance system as set forth in claim 3, in which said master musical instrument further includes other actuators provided for said plural manipulators and selectively energized with driving signals so as to give rise to movements of said plural manipulators on trajectories, and another controlling system connected to said communication system and said other actuators and selectively supplying said driving signals produced on the basis of said pieces of performance data to said other actuators so as selectively to move said other manipulators on said trajectories, and in which said slave musical instrument further includes another converter monitoring said other manipulators and producing detecting signals representative of physical quantity expressing movements of said other manipulators and another information processing system connected between said another converter and said another communication system and producing pieces of performance data expressing a performance on said other manipulators on the basis of said physical quantity so as to make said another communication system transmit said pieces of performance data expressing said performance on said other manipulators to said communication system, wherein said pieces of performance data are bi-directionally propagated between said communication system and said another communication system through said communication channel so that pieces of music are concurrently performed on both of said master musical instrument and said slave musical instrument in synchronism with each other.

5. A music performance system for a music performance on plural musical instruments, comprising:

a master musical instrument including plural manipulators selectively moved for specifying tones to be produced, a converter monitoring said plural manipulators and producing detecting signals representative of physical quantity expressing movements of said plural manipulators, an information processing system connected to said converter and producing pieces of performance data expressing a performance on said plural manipulators on the basis of said physical quantity, and a communication system connected between said information processing system and a communication channel for transmitting said pieces of performance data through said communication channel;

a slave musical instrument including another communication system connected to said communication channel and receiving said pieces of performance data from said communication system, other manipulators for specifying tones to be produced, plural actuators provided for said other manipulators and selectively energized with driving signals so as to give rise to movements of said other manipulators on trajectories, a mechanical tone generating system connected to said other manipulators and producing acoustic tones when said other manipulators strongly actuate said mechanical tone generating system, and a controlling system connected to said another communication system and said plural actuators and selectively supplying said driving signals produced on the basis of said pieces of performance data to said plural actuators so as selectively to move said other manipulators on said trajectories; and a delay canceller provided in association with said information processing system so as to reduce a time lag between the transmission of said pieces of performance data and the generation of said acoustic tones, wherein said delay canceller has a pre-estimator connected between said converter and said information processing system and presuming a generation of tone at a time later than the present time by at least part of said delay time so as to make said information processing system produce said pieces of performance data containing pieces of event data expressing the presumed tone generation.

6. The music performance system as set forth in claim 5, in which said delay canceller further has an experimenter determining the amount of said delay time and informing said pre-estimator of said amount of said delay.

7. The music performance system as set forth in claim 5, in which said master musical instrument further includes another mechanical tone generating system connected to said plural manipulators and producing acoustic tones when said plural manipulators strongly actuate said another mechanical tone generating system so that said slave musical instrument generates said electric tones or said acoustic tones concurrently with said acoustic tones produced through said master musical instrument.

8. The music performance system as set forth in claim 7, in which said master musical instrument further includes other actuators provided for said plural manipulators and selectively energized with driving signals so as to give rise to movements of said plural manipulators on trajectories, and another controlling system connected to said communication system and said other actuators and selectively supplying said driving signals produced on the basis of said pieces of performance data to said other actuators so as selectively to move said other manipulators on said trajectories, and in which said slave musical instrument further includes another converter monitoring said other manipulators and producing detecting signals representative of physical quantity expressing movements of said other manipulators and another information processing system connected between said another converter and said another communication system and producing pieces of performance data expressing a performance on said other manipulators on the basis of said physical quantity so as to make said another communication system transmit said pieces of performance data expressing said performance on said other manipulators to said communication system, wherein said pieces of performance data are bi-directionally propagated between said communication system and said another communication system through said communication channel so that pieces of music are concurrently performed on both of said master musical instrument and said slave musical instrument in synchronism with each other.

9. A musical instrument forming a part of a music performance system, comprising:

plural manipulators selectively moved for specifying tones to be produced;

a converter monitoring said plural manipulators, and producing detecting signals representative of physical quantity expressing movements of said plural manipulators;

an information processing system connected to said converter, and producing pieces of performance data expressing a performance on said plural manipulators on the basis of said physical quantity;

a communication system connected between said information processing system and a communication channel for transmitting said pieces of performance data to another musical instrument through said communication channel; and a delay canceller provided in association with said information processing system so as to reduce a time lag between the transmission of said pieces of performance data and the generation of acoustic tones through said another musical instrument, wherein said delay canceller has a pre-estimator presuming said physical quantity at a time later than the present time by at least part of said delay time so as to make said pieces of performance data contain pieces of motion data expressing the presumed physical quantity.

10. The musical instrument as set forth in claim 9, in which said delay canceller further has an experimenter determining the amount of said delay time and informing said pre-estimator of said amount of said delay.

11. The musical instrument as set forth in claim 9, further comprising a tone generating system connected to said plural manipulators and responsive to movements of said plural manipulators for producing tones specified through said plural manipulators.

12. A musical instrument forming a part of a music performance system, comprising:

plural manipulators selectively moved for specifying tones to be produced;

a converter monitoring said plural manipulators, and producing detecting signals representative of physical quantity expressing movements of said plural manipulators;

an information processing system connected to said converter, and producing pieces of performance data expressing a performance on said plural manipulators on the basis of said physical quantity;

a communication system connected between said information processing system and a communication channel for transmitting said pieces of performance data to another musical instrument through said communication channel; and a delay canceller provided in association with said information processing system so as to reduce a time lag between the transmission of said pieces of performance data and the generation of acoustic tones through said another musical instrument, wherein said delay canceller has a pre-estimator connected between said converter and said communication system and presuming a generation of tone at a time later than the present time by at least part of said delay time so as to make said information processing system produce said pieces of performance data containing pieces of event data expressing the presumed tone generation.

13. The musical instrument as set forth in claim 12, in which said delay canceller further has an experimenter determining the amount of said delay time and informing said pre-estimator of said amount of said delay.

14. The musical instrument as set forth in claim 12, further comprising a tone generating system connected to said plural manipulators and responsive to movements of said plural manipulators for producing tones specified through said plural manipulators.

15. A musical instrument forming a part of a music performance system, comprising:

a communication system connected to a communication channel, and receiving pieces of performance data expressing movements of manipulators of another musical instrument through said communication channel;

plural manipulators for specifying tones to be produced;

plural actuators provided for said plural manipulators, and selectively energized with driving signals so as to give rise to movements of said plural manipulators on trajectories;

a mechanical tone generating system connected to said plural manipulators, and producing acoustic tones when said plural manipulators strongly actuates said mechanical tone generating system;

an electronic tone generating system for producing electric tones on the basis of said pieces of performance data;

a controlling system connected to said communication system, said plural actuators and said electronic tone generating system, and selectively supplying said driving signals produced on the basis of said pieces of performance data to said plural actuators so as selectively to move said plural manipulators on said trajectories and said pieces of performance data to said electronic tone generating system so as to produce said electric tones; and a delay canceller provided in association with at least one of said electronic tone generating system and controlling system so as to reduce a time lag between transmission of said pieces of performance data and the generation of said electric tones or said acoustic tones, in which said pieces of performance data contain pieces of motion data expressing presumed physical quantity at a time later than a past time, at which physical quantity expressing said movement of other manipulator of another musical instrument is determined, by at least a part of said delay time, wherein said delay canceller has a selector for selecting said mechanical tone generating system and a controller causing said plural actuators to force said plural manipulators to have said presumed physical quantity, whereby said plural manipulators strongly actuate said mechanical tone generating system for producing said acoustic tones.

16. The musical instrument as set forth in claim 15, in which said mechanical tone generating system includes action units connected to keys serving as said plural manipulators, hammers connected to said action units, and driven for rotation through said action units when said keys are depressed, and strings opposed to said hammers and producing said acoustic tones when said hammers are brought into collision therewith at the end of said rotation.

17. A musical instrument forming a part of a music performance system, comprising:

a communication system connected to a communication channel, and receiving pieces of performance data expressing movements of manipulators of another musical instrument through said communication channel;

plural manipulators for specifying tones to be produced;

plural actuators provided for said plural manipulators, and selectively energized with driving signals so as to give rise to movements of said plural manipulators on trajectories;

a mechanical tone generating system connected to said plural manipulators, and producing acoustic tones when said plural manipulators strongly actuate said mechanical tone generating system;

an electronic tone generating system for producing electric tones on the basis of said pieces of performance data;

a controlling system connected to said communication system, said plural actuators and said electronic tone generating system, and selectively supplying said driving signals produced on the basis of said pieces of performance data to said plural actuators so as selectively to move said plural manipulators on said trajectories and said pieces of performance data to said electronic tone generating system so as to produce said electric tones; and a delay canceller provided in association with at least one of said electronic tone generating system and controlling system so as to reduce a time lag between transmission of said pieces of performance data and the generation of said electric tones or said acoustic tones, wherein said controlling system has a simulator making said plural actuators weakly move said plural manipulators so that the weakly moved actuators give rise to movements of said plural manipulators without production of said acoustic tones in synchronism with said electric tones.

* * * * *